US009955758B2

(12) United States Patent
Huynh

(10) Patent No.: US 9,955,758 B2
(45) Date of Patent: May 1, 2018

(54) JEWELRY ITEM, METHOD OF MANUFACTURING A CLOSURE FOR JEWELRY ITEM, FINDING FOR AN EARRING, KIT OF PARTS FORMING THE FINDING, AND EARRING CONSTRUCTED FROM THE KIT

(71) Applicant: Grand Rainbow International Limited, Causeway Bay (CN)

(72) Inventor: Khanh Tan Huynh, Ashwood (AU)

(73) Assignee: Grand Rainbow International Limited, Kowloon (HK)

( * ) Notice: Subject to any disclaimer, the term of this patent is extended or adjusted under 35 U.S.C. 154(b) by 0 days. days.

(21) Appl. No.: 14/396,386

(22) PCT Filed: Apr. 24, 2013

(86) PCT No.: PCT/IB2013/053232

§ 371 (c)(1),
(2) Date: Oct. 23, 2014

(87) PCT Pub. No.: WO2013/160842

PCT Pub. Date: Oct. 31, 2013

(65) Prior Publication Data

US 2015/0075219 A1 Mar. 19, 2015

Related U.S. Application Data

(63) Continuation-in-part of application No. 13/555,154, filed on Jul. 22, 2012, now Pat. No. 9,730,497, which
(Continued)

(51) Int. Cl.
*A44C 7/00* (2006.01)
*A44C 5/00* (2006.01)
(Continued)

(52) U.S. Cl.
CPC ..... *A44C 7/00* (2013.01); *A44C 5/00* (2013.01); *A44C 9/00* (2013.01); *A44C 27/00* (2013.01);
(Continued)

(58) Field of Classification Search
CPC ..... A44C 7/006; A44C 7/00; A44C 7/003; A44C 5/12; A44C 7/007; A44C 9/0046;
(Continued)

(56) References Cited

U.S. PATENT DOCUMENTS 240,857 A 5/1881 Smith
247,876 A * 10/1881 Becker ..... A44C 5/12 63/9
(Continued)

FOREIGN PATENT DOCUMENTS

CN 1216447 5/1999
CN 1392778 1/2003
(Continued)

OTHER PUBLICATIONS

Written Opinion dated Jun. 8, 2015 From the Intellectual Property Office of Singapore Re. Application No. 11201406851Q.
(Continued)

*Primary Examiner* — Jack W Lavinder

(57) ABSTRACT

A jewelry item has a ring part pivotally attached to a closure at one end. The closure spans the continuity of the ring from an end of the ring part and comprises a ring continuation arm extending in continuity of the ring and pivotally attached to and of the ring part at a pivoted connection. The closure further comprises a bias arm extending along with the ring continuation arm along said ring continuity. The bias arm comprises a spring part and a lever part pivotally attached to each other. A connection between said lever part and the ring part is rigid, so that as the ring part is opened, said lever part
(Continued)

is configured to rotate inwardly towards an interior of said item. The spring part has a natural shape of smaller circumference than the ring part so that once a certain extent is reached, the spring part pulls the lever part towards the spring part in order to allow the spring part to attain its smaller diameter and thus establish a stable open position. The lever part further on closure of the ring part, is configured to push the spring part outwardly towards the ring continuation arm to establish a second stable position to close the closure. Another jewelry item comprising a spring arm pivoted to said continuation at a first location thereon and further pivoted to its ring part at a second location is disclosed. A method of manufacturing a closure for a jewelry item, a finding for an earring, a kit of parts constructed to form the finding and an earring constructed from the kit of parts and a mounting are also disclosed.

15 Claims, 25 Drawing Sheets

Related U.S. Application Data is a continuation-in-part of application No. 13/454,231, filed on Apr. 24, 2012, now Pat. No. 8,881,550.

(51) Int. Cl.
*A44C 9/00* (2006.01)
*A44C 27/00* (2006.01)

(52) U.S. Cl.
CPC ..... *A44C 7/004* (2013.01); *A44C 9/0046* (2013.01); *Y10T 29/49595* (2015.01)

(58) Field of Classification Search
CPC .. A44C 9/00; A44C 5/00; A44C 27/00; A44B 6/00; Y10T 16/5383
USPC ..... 63/14.5, 12, 13, 8; 267/158; 16/227, 16/277, 297, DIG. 36
See application file for complete search history.

(56) References Cited

U.S. PATENT DOCUMENTS

| | | | | |
|---|---|---|---|---|
| 271,121 | A | | 1/1883 | Riley et al. |
| 1,967,965 | A | | 7/1934 | Morehouse et al. |
| 2,733,491 | A | | 2/1956 | Saccoccio |
| 4,694,664 | A | | 9/1987 | Elsener |
| 4,815,180 | A | | 3/1989 | Elsener |
| 5,025,643 | A | | 6/1991 | Chan et al. |
| 5,079,933 | A | | 1/1992 | Alviti |
| 5,468,220 | A | * | 11/1995 | Sucher ..... 602/21 |
| 5,487,280 | A | | 1/1996 | D'Amore, Jr. |
| D378,360 | S | | 3/1997 | Montaquila |
| 5,816,073 | A | * | 10/1998 | Bardisbanyan ..... 63/12 |
| 6,460,221 | B1 | | 10/2002 | Eromaki |
| 6,843,072 | B1 | | 1/2005 | Lau |
| 7,121,118 | B2 | | 10/2006 | David |
| 7,347,065 | B1 | | 3/2008 | DeGolyer |
| 2005/0247079 | A1 | | 11/2005 | Padeh |
| 2011/0056241 | A1 | | 3/2011 | Li |
| 2013/0276477 | A1 | | 10/2013 | Iiuynh |
| 2013/0276478 | A1 | | 10/2013 | Huynh |
| 2015/0027167 | A1 | | 1/2015 | Huynh |

FOREIGN PATENT DOCUMENTS

| | | | |
|---|---|---|---|
| DE | G9314157.2 | | 11/1993 |
| GB | 295566 | * | 4/1928 |
| JP | 63-083020 | | 5/1988 |
| JP | 09-065911 | | 3/1997 |
| JP | 09-108012 | | 4/1997 |
| JP | 09-164008 | | 6/1997 |
| JP | 2000-102405 | | 4/2000 |
| JP | 2001-087014 | | 4/2001 |
| RU | 2258447 | | 8/2005 |
| WO | WO 98/36656 | | 8/1998 |
| WO | WO 02/32250 | | 4/2002 |
| WO | WO 2013/160842 | | 10/2013 |

OTHER PUBLICATIONS

Official Action dated Feb. 24, 2015 From the US Patent and Trademark Office Re. U.S. Appl. No. 13/555,154.
International Preliminary Report on Patentability dated Nov. 6, 2014 From the International Bureau of WIPO Re. Application No. PCT/IB2013/053232.
Applicant-Initiated Interview Summary dated Nov. 7, 2013 From the US Patent and Trademark Office Re. U.S. Appl. No. 13/454,231.
International Search Report and the Written Opinion dated Sep. 26, 2013 From the International Searching Authority Re. Application No. PCT/IB2013/053232.
Notice of Allowance dated Jun. 30, 2014 From the US Patent and Trademark Office Re. U.S. Appl. No. 13/454,231.
Official Action dated Aug. 1, 2013 From the US Patent and Trademark Office Re. U.S. Appl. No. 13/454,231.
Official Action dated Sep. 9, 2014 2014 From the US Patent and Trademark Office Re. U.S. Appl. No. 13/555,154.
Official Action dated Oct. 17, 2013 From the US Patent and Trademark Office Re. U.S. Appl. No. 13/454,231.
Official Action dated Mar. 26, 2014 From the US Patent and Trademark Office Re. U.S. Appl. No. 13/454,231.
Official Action dated May 28, 2014 From the US Patent and Trademark Office Re. U.S. Appl. No. 13/454,231.
Restriction Official Action dated May 22, 2013 From the US Patent and Trademark Office Re. U.S. Appl. No. 29/427,744.
Restriction Official Action dated Jun. 30, 2014 From the US Patent and Trademark Office Re. U.S. Appl. No. 13/555,154.
Official Action dated Jun. 4, 2015 From the US Patent and Trademark Office Re. U.S. Appl. No. 13/555,154.
Notification of Office Action dated Apr. 5, 2016 From The State Intellectual Property Office of the People's Republic of China Re. Application No. 201380021816.6.
Official Action dated Apr. 14, 2016 From the US Patent and Trademark Office Re. U.S. Appl. No. 14/513,272.
Translation of Notification of Office Action dated Apr. 5, 2016 From The State Intellectual Property Office of the People's Republic of China Re. Application No. 201380021816.6.
Official Action dated Feb. 1, 2016 From the US Patent and Trademark Office Re. U.S. Appl. No. 13/555,154.
Patent Examination Report dated Jan. 18, 2016 From the Australian Government, IP Australia Re. Application No. 2013254276.
Supplementary European Search Report and the European Search Opinion dated Aug. 26, 2015 From the European Patent Office Re. Application No. 13781289.7.
Notification of Office Action and Search Report dated Aug. 11, 2015 From The State Intellectual Property Office of the People's Republic of China Re. Application No. 201380021816.6.
Translation dated Aug. 30, 2015 of Notification of Office Action and Search Report dated Aug. 11, 2015 From The State Intellectual Property Office of the People's Republic of China Re. Application No. 201380021816.6.
Official Action dated Oct. 7, 2015 From the US Patent and Trademark Office Re. U.S. Appl. No. 13/555,154.
Ex Paste Quayle OA dated Jul. 15, 2016 From the US Patent and Trademark Office Re. U.S. Appl. No. 13/555,154.
Notification of Office Action and Search Report dated Sep. 20, 2016 From The State Intellectual Property Office of the People's Republic of China Re. Application No. 201380021816.6 and Its Translation Into English.
Advisory Action Before the Filing of an Appeal Brief dated Jan. 18, 2017 From the US Patent and Trademark Office Re. U.S. Appl. No. 13/555,154. (3 pages).

(56) References Cited

OTHER PUBLICATIONS

Communication Pursuant to Article 94(3) EPC dated Nov. 28, 2016 From the European Patent Office Re. Application No. 13781289.7. (6 Pages).
Official Action dated Oct. 6, 2016 From the US Patent and Trademark Office Re. U.S. Appl. No. 13/555,154.
Ex Parte Quayle OA dated Jul. 15, 2016 From the US Patent and Trademark Office Re. U.S. Appl. No. 13/555,154.
Advisory Action Before the Filing of An Appeal Brief dated Mar. 15, 2017 From the US Patent and Trademark Office Re. U.S. Appl. No. 13/555,154. (3 pages).
Communication Pursuant to Article 94(3) EPC dated May 26, 2017 From the European Patent Office Re. Application No. 13781289.7. (4 Pages).
Decision on Granting a Patent for Invention, Conclusion Upon the Results of the Examination and Search Report dated Apr. 19, 2017 From the Federal Service for Intellectual Property ROSPATENT, Federal State Budgetary Institution, Federal Institute of Industrial Property of the Russian Federation Re. Application No. ROSPATENT and Its Translation Into English. (26 Pages).
Notice of Reasons for Refusal dated May 22, 2017 From the Japan Patent Office Re. Application No. 2015-507646 and Its Translation Into English. (13 Pages).
Notice of Reasons for Refusal dated Sep. 12, 2017 From the Japan Patent Office Re. Application No. 2015-507646 and Its Translation Into English. (11 Pages).

* cited by examiner

JEWELRY ITEM, METHOD OF MANUFACTURING A CLOSURE FOR JEWELRY ITEM, FINDING FOR AN EARRING, KIT OF PARTS FORMING THE FINDING, AND EARRING CONSTRUCTED FROM THE KIT

RELATED APPLICATIONS

This application is a National Phase of PCT Patent Application No. PCT/IB2013/053232 having International filing date of Apr. 24, 2013, which is a Continuation-In-Part (CIP) of U.S. patent application Ser. No. 13/555,154 filed on Jul. 22, 2012, which is a Continuation-In-Part (CIP) of U.S. patent application Ser. No. 13/454,231 filed on Apr. 24, 2012. The contents of the above applications are all incorporated by reference as if fully set forth herein in their entirety.

FIELD AND BACKGROUND OF THE INVENTION

The present invention, in some embodiments thereof, relates to closures and findings, and more particularly but not exclusively to closures and findings for items such as jewelry, especially rings, bracelets and earrings and including Huggie earrings, as well as, jewelry items containing the closures and findings combined with a mounting.

Rings with closures are useful in the case of fingers whose sizes change over the course of a lifetime, not an uncommon phenomenon. As well as change in size, arthritic joints can make it painful to allow closely fitting rings or bracelets to slide over.

Huggie earrings are a popular style of earring and are so-called because the setting hugs the earlobe. Many custom jewelers make huggie earrings because of the many varieties of setting that can be used. For example, stones may be channel set in huggie earrings. Settings for huggie earrings may come in different shapes and sizes, including hearts, rectangles, ring shapes and horseshoes.

Huggie earrings generally have closure mechanisms which provide an open position in which the pin is exposed for insertion or removal from the piercing, and a closed position for holding the earring in position once inserted.

FIG. 1A shows a basic ring-shaped huggie earring in profile and seen side on. The setting is hinged so that the earring can be opened. The earring is then inserted into the piercing and may then be closed to hold the earring securely in place. A catch holds the hinged part in position in the closed position and may be released in order to open the earring.

FIG. 1B shows a profile and perspective view of a huggie earring with five rows of gemstones in the setting, placed using an invisible setting technique.

FIG. 1C shows a profile and side-on view of another huggie earring with gemstones set in two rows using an invisible setting technique.

The closure mechanism in each case consists of a sprung catch with a release mechanism. The catch and release mechanism consists of several moving parts, each of which can be a separate cause of failure so that each moving part reduces the overall life expectancy of the product. In addition, the catch and release mechanism is intrinsically awkward to use since it must be operated whilst on the ear of the wearer, a position which the wearer is unable to see so must work on touch alone.

SUMMARY OF THE INVENTION

According to one embodiment of the present invention there is provided a jewelry item, the jewelry item having a ring part pivotally attached to a closure at one end, the closure spanning the continuity of the ring from an end of the ring part and comprising a ring continuation arm extending in continuity of the ring and pivotally attached to an end of the ring part at a pivoted connection, the closure further comprising a bias arm extending along with the ring continuation arm along the ring continuity, the bias arm comprising a spring part and a lever part pivotally attached to each other, a connection between the lever part and the ring part being rigid, so that as the ring part is opened, the lever part is configured to rotate inwardly towards an interior of the item, pulling the pivoted end of the spring part, the spring part having a natural shape of smaller circumference than the ring part so that once a certain extent is reached, the spring part pulls the lever part towards the spring part in order to allow the spring part to attain its smaller diameter and thus establish a stable open position, the lever further on closure of the ring part, being configured to push the spring part outwardly towards the ring continuation arm to establish a second stable position to close the closure.

As well as the jewelry item itself, the embodiments may relate to the closure, to the finding, and to a kit of parts to construct the closure or the finding or the full jewelry item.

In an embodiment, the lever part is relatively shorter than the spring part.

In an embodiment, the jewelry item comprises an caning, the earring comprising a pin for insertion into an ear, and the closure being for closing the pin against the ring part, a first end of the closure being on the ring and the second end being a free end, the closed position being a position in which the closure abuts against the pin to close the caning and the open position being a position in which the closure is spaced away from the pin to open the earring.

In an embodiment, the jewelry item comprises a ring or a bracelet, the ring comprising a band and the closure being incorporated into the band, the closed position being a position in which the closure closes the band to a uniform ring circumference and the open position being a position in which the band is opened beyond the circumference.

In an embodiment, the spring part extends inwardly of a circumference of the ring continuity when the closure is opened.

In an embodiment, the spring part remains within the outer circumference when the closure is opened.

In an embodiment, the spring part is approximately four times as long as the lever part.

In an embodiment, the bias arm is continuous with a ring structure of the jewelry item.

An embodiment may provide a huggie style earring.

According to a second aspect of the present invention there is provided a jewelry item comprising a ring part and a closure, the closure being continuous with the ring part and connecting to the ring part at a first end, the closure comprising a continuation of the ring part and a spring arm pivoted to the continuation at a first location thereon and further pivoted to the ring part at a second location, the continuation having a pivoted hinge located at the first end, the first end being between the first location and the second location, thereby providing the closure with a first open stable position and a second closed stable position and a snapping motion between the first and second stable positions.

In an embodiment, the connecting between the ring part and the continuation is via a pivot.

In an embodiment, the connecting between the ring part and the continuation is continuous.

In an embodiment, the first end is closer to the first location than to the second location.

In an embodiment, the jewelry item comprises an caning, the earring comprising a setting and a pin, and the closure for closing over the pin, the first end being on the setting and the second end being a free end of the pin, the first position being a position in which the closure connects to the pin to close the caning and the second position being a position in which the closure is spaced away from the pin to open the caning, or wherein the jewelry item comprises a ring or a bracelet, the ring comprising a band and the closure being incorporated into the band, the first and second ends being on the band, the first position being a position in which the closure connects the band to close the ring and the second position being a position in which the closure opens the band.

In an embodiment, the leaf spring sits within an outer circumference of the item when the closure is closed, and the leaf spring extends outwardly of the outer circumference when the closure is opened.

According to a third aspect of the present invention there is provided a method of manufacturing a closure for a jewelry item, comprising:

providing a ring part;

constructing a closure by providing a segment within the ring part, the segment being attached at one end to the ring part, a second end being free to open and close;

providing a leaf spring, the leaf spring being attached at one end to the ring part and at a second end to a first pivot on the segment;

providing an intermediate pivoted joint within the segment between the attached end and the first pivot; thereby configuring the closure to flip between two stable positions.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

The present invention, in some embodiments thereof, relates to closures and findings for articles such as items of jewelry, and more particularly but not exclusively to jewelry, for example rings, bracelets and earrings, such as huggie earrings. The invention may also relate to the items of jewelry themselves.

An caning may have a setting and a pin, and a closure for closing over the pin. The pin and closure comprise the finding. The closure consists of a leaf spring extending outwardly in a first loop part from a first location on the setting and looping back in a second loop part to a second location adjacent the first location on the setting. The loop parts each have shape memory and are set with different remembered shapes. The two different remembered shapes work against each other to flip the closure between two stable positions, a first position in which the closure connects to the pin to close the earring and a second position in which the closure is spaced away from the pin to open the earring. The design is particularly suitable for a huggie style earring.

A one part locking mechanism piece may thus be made of such a looped over leaf spring. The leaf spring may have two pivoted hinges or soldered joints fixed to the setting and may always flip between one of two stable positions caused by two remembered shapes of each half of the loop working against each other. The mechanism consists of a single part and thus does not have the problems of known earrings because there is no isolated spring or catch or other separate parts, thus reducing the overall failure rate.

The looped over leaf spring thus provides a catch mechanism based on the two stable states, an open state allowing attachment and detachment of the earring from the earlobe and a closed state, locking the earring in position on the earlobe. The mechanism is applicable not just to huggie style earrings but to any kind of earring or any other piercing or any kind of jewelry which requires an easy to operate mechanism for locking in position.

The looped over leaf spring may be made of two different metals fused together to enhance the shape memory.

Figure 1A:
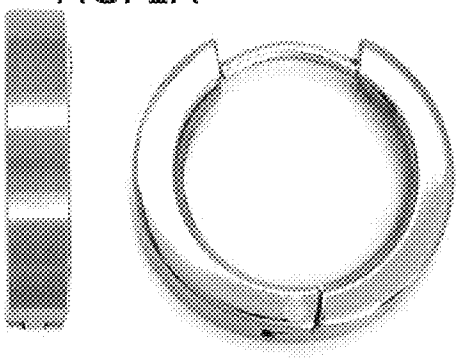
FIGS. 1A-1C are examples of prior art huggie earrings.
Figure 1B:
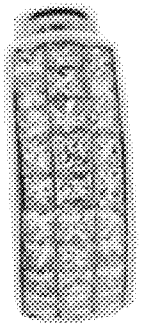
Figure 1B:
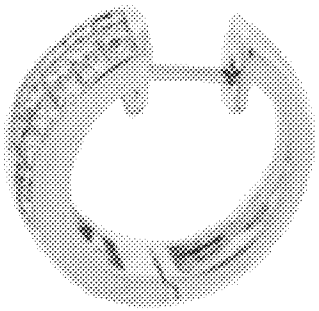
Figure 1C:
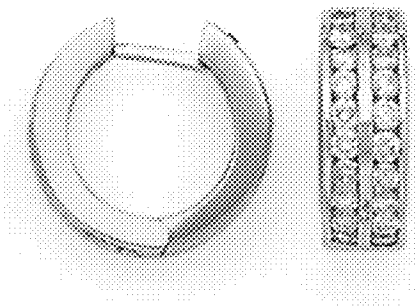
FIG. 1C Prior Art

FIGS. 1A-1C are discussed in the background and show examples of three huggie earrings of the known art. Each of the earrings shown has a closing mechanism that comprises a hinge with a spring or other type of locking mechanism, the additional parts increasing the failure rate.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Figure 2:
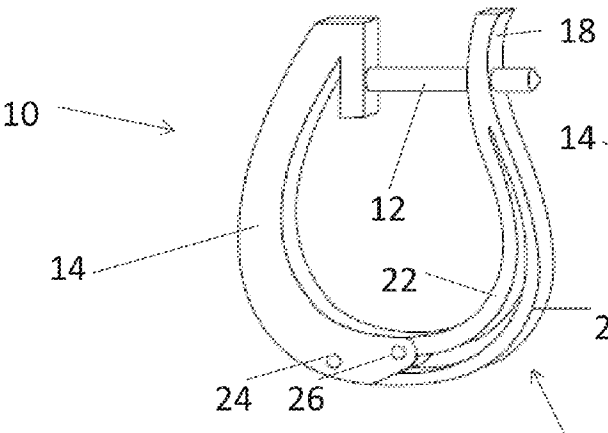
FIG. 2 is a perspective view of a huggie earring according to a horseshoe embodiment of the two-stable positions feature with the closure in a closed position.
Figure 3:
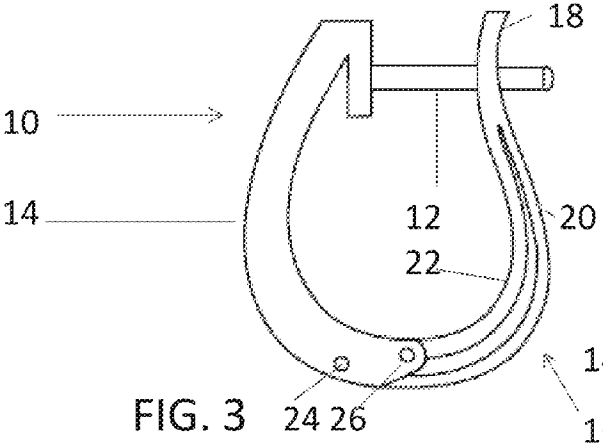
FIG. 3 is a two-dimensional view of the caning of FIG. 2.

Referring now to the drawings, FIG. 2 is a simplified diagram showing a schematic three-dimensional perspective view of a huggie earring illustrating the principle of the two stable positions. FIG. 3 is a two dimensional profile of the same embodiment. In FIG. 2, a huggie earring 10 comprises a pin 12 for fitting through the piercing, a front setting part 14 and a closure part 16. The closure part 16 comprises a leaf spring element 18 that forks into upper 20 and lower 22 leaf spring continuations or prongs. From another point of view the leaf spring starts at one prong, extends to base element 18 and loops back as the other prong. Each of the leaf spring continuations is attached separately by a respective hinge 24 and 26, to the setting 14. The hinges or pivots allow each leaf spring continuation to rotate independently, and thus give rise to two stable positions as will be detailed below and include a mechanism for flipping or jumping between them.

The balance of forces between the two leaf spring continuations mandates two stable positions, one as shown in FIGS. 2 and 3 in which the earring closure is closed and a second position where the earring is open and the pin is free to be inserted and removed from the ear piercing. This contrasts with the prior art systems of FIGS. 1A-C where a single hinge is spring loaded to flip between open and closed positions.

Figure 4:
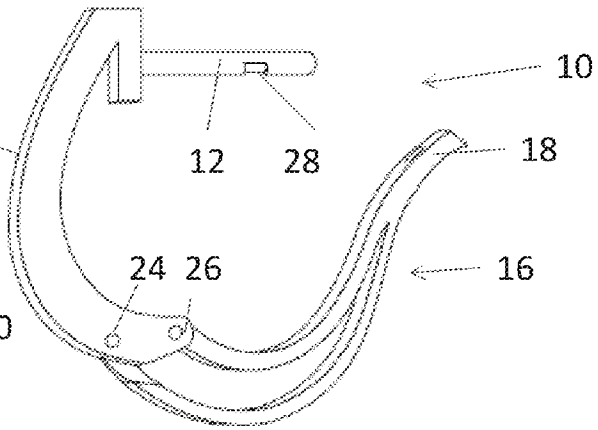
FIG. 4 is a perspective view of the huggie earring of FIG. 2 with the closure in an open position.
Figure 5:
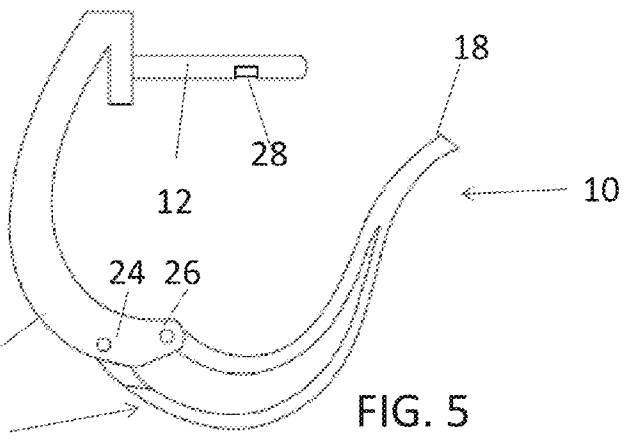
FIG. 5 is a two-dimensional view of the caning of FIG. 4.

Reference is now made to FIGS. 4 and 5, which are 3D perspective and 2D face on views of the huggie earring of FIG. 2 in the open position. Parts that are the same as in preceding figures are provided with the same reference numerals and are not described again except as needed for understanding the present figure.

In FIG. 4 the closure part 16 has been opened by rotating closure end 18, causing leaf spring continuations 20 and 22 to rotate on pivots 24 and 26 and reach a second stable position. An inclusion 28 on the pin catches the lower end of the closure when in the first stable position, that is the closed position.

Figures 6, 7, 8:
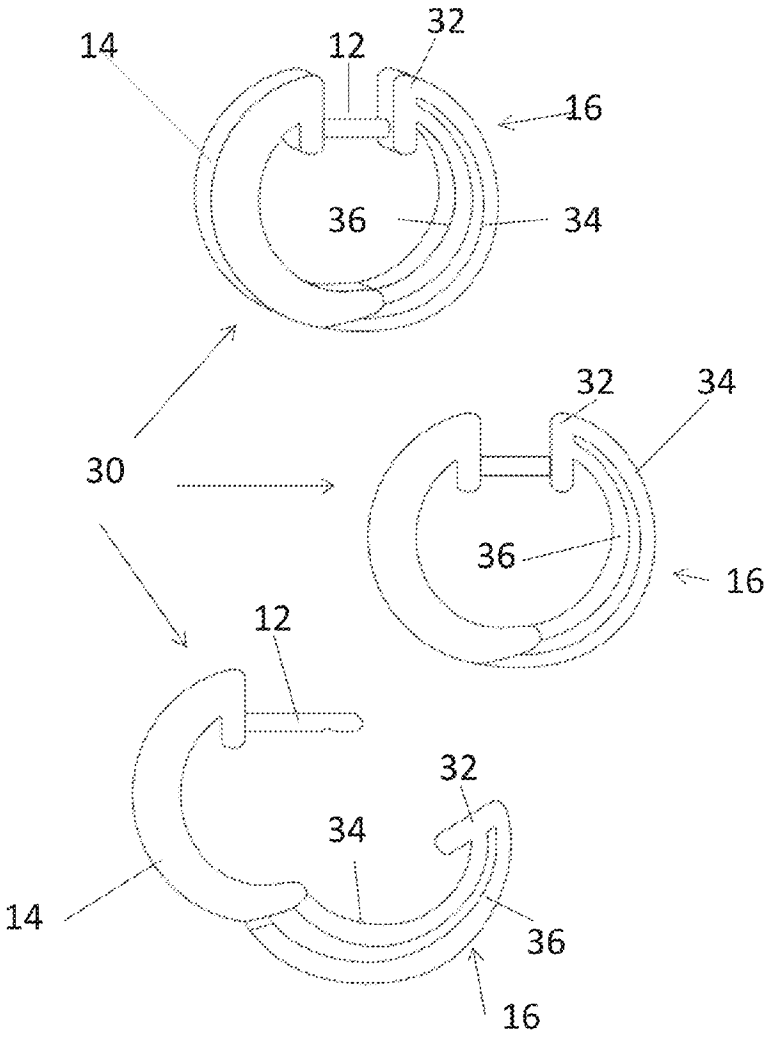
FIG. 6 is a perspective view of a huggie earring according to a round embodiment further illustrating the principle of the two stable positions.
FIG. 7 is a two-dimensional view of the huggie earring of FIG. 6.
FIG. 8 is a two-dimensional view of the huggie earring of FIG. 6 in an open position.

FIGS. 6-8 illustrate a rounded version 30 of a huggie earring. FIG. 6 is a simplified 3 dimensional perspective view of the rounded earring 30. FIG. 7 is a two dimensional view showing a cross-section of the earring, and FIG. 8 is a two dimensional view showing the earring in the open position. In rounded earring 30 the top 32 of the closure 16 is a bar. Leaf springs 34 and 36 extend at right angles from two different locations at different heights of the bar 32 and curve downwards. At the far end the leafsprings are soldered or welded onto respective locations on the setting 14. From another point of view a single continuous leaf spring begins at one of the welds, loops up via bar 32 and then continues down the leaf spring extension to the second weld. The springiness of the two leafsprings 34 and 36 allows them to alternate between two stable positions as in the previous embodiments. Pivots however could be used as an alternative, and for that matter, soldering could be used on the horseshoe shaped earring 10.

Reference is now made to FIDS. 9 and 10 which further illustrate the principle of the two stable positions. A single continuous length of leafspring 40 is curved back on itself and moves under the constraint that the two ends 42 and 44 of the leafspring are fixed. The two sides of the leafspring push against each other as they attempt to move within the constraints. The leafsprings typically have a shape memory so that two equilibrium positions can be defined, such as those shown in FIG. 9 and FIG. 10. That is to say a different shape may be provided to each side of the looped leafspring and then the closure is flipped between a first stable position where a first side is dominant and a second stable position where the second side is dominant.

Figure 9:
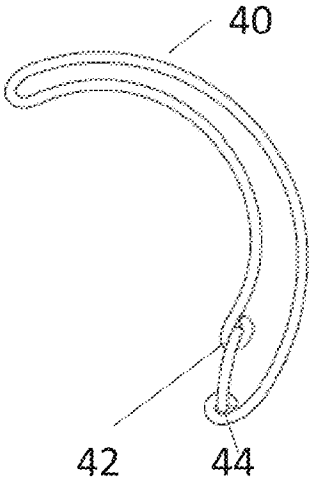
FIG. 9 is a schematic drawing showing a looped leaf-spring in a first stable position.
Figure 10:
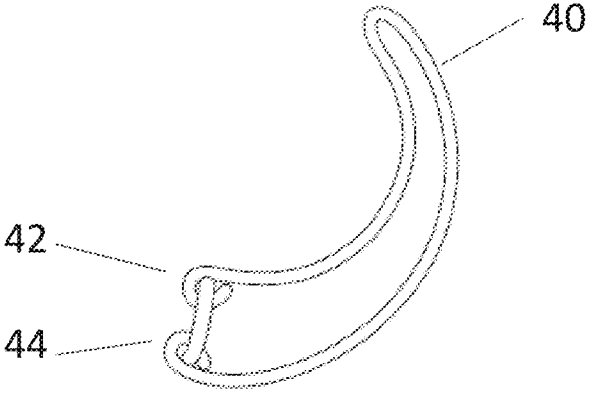
FIG. 10 is a schematic drawing showing a looped leaf-spring in a second stable position.

The position in FIG. 9 may be used to provide the closed position of the huggie caning and that of FIG. 10 may provide the open position of the earring.

Figure 11:
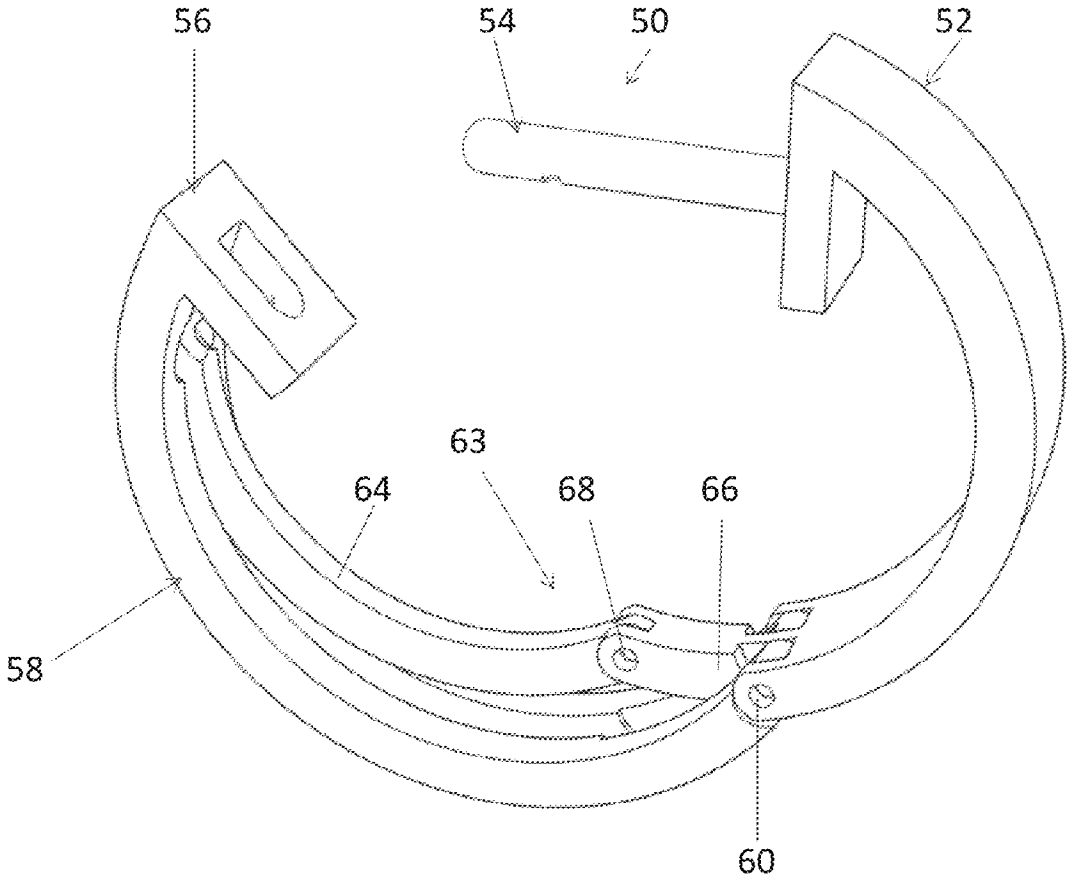
FIG. 11 illustrates a huggie earring according to a first embodiment of the present invention in which an intermediate pivot is used to lock the closure into either of the two stable positions.

Reference is now made to FIG. 11, which shows a huggie earring 50 according to an embodiment of the present invention. The huggie earring has a ring part 52 extending from an ear insertion part 54. The ring part is pivotally attached to a closure 56 at one end, the ear insertion part being located at the other end. The closure 56 spans the continuity of the ring from the end of the ring part 52 back to the ear insertion part 54. The closure 56 comprises a ring continuation arm 58 extending in continuity of the ring and pivotally attached to the end of the ring part 52 at pivoted connection 60. An inner arm 63 underlies the ring continuation arm 58 and itself consists of two sections, arm part 64 and a lever part 66. The two sections 64 and 66 are pivotally attached to each other at pivot 68. The lever part 66 and the ring part 52 are continuous, so that as the ring part is opened, lever part 66 rotates inwardly towards the interior of the ring, pulling the pivoted end of the-arm part 64. The bias arm 58 is thereby forced into a smaller circumference by the inner part which consists of arm part 64 and lever part 66. That is to say, the lever part rotates inwardly towards an interior of ring, pulling the pivoted end of the spring part to constrain the ring continuation arm and thus establish the stable open position. Thus once a certain opening extent is reached, the inner part 64, 66 pulls the ring continuation part—58 into a smaller diameter shape in order to establish a stable open position.

As the ring is closed, the lever, 66 aligns along the ring continuation part, pulling the spring part to align as well and establish a second stable position, which closes the earring. In the second stable position the lever 66 simply presses part 64 against the ring continuation part 58. The pivot 68 may be considerably closer to the ring part 52 than to the ear insertion part 54, so that the inner arm is around four or six times longer than the lever part.

Figure 12:
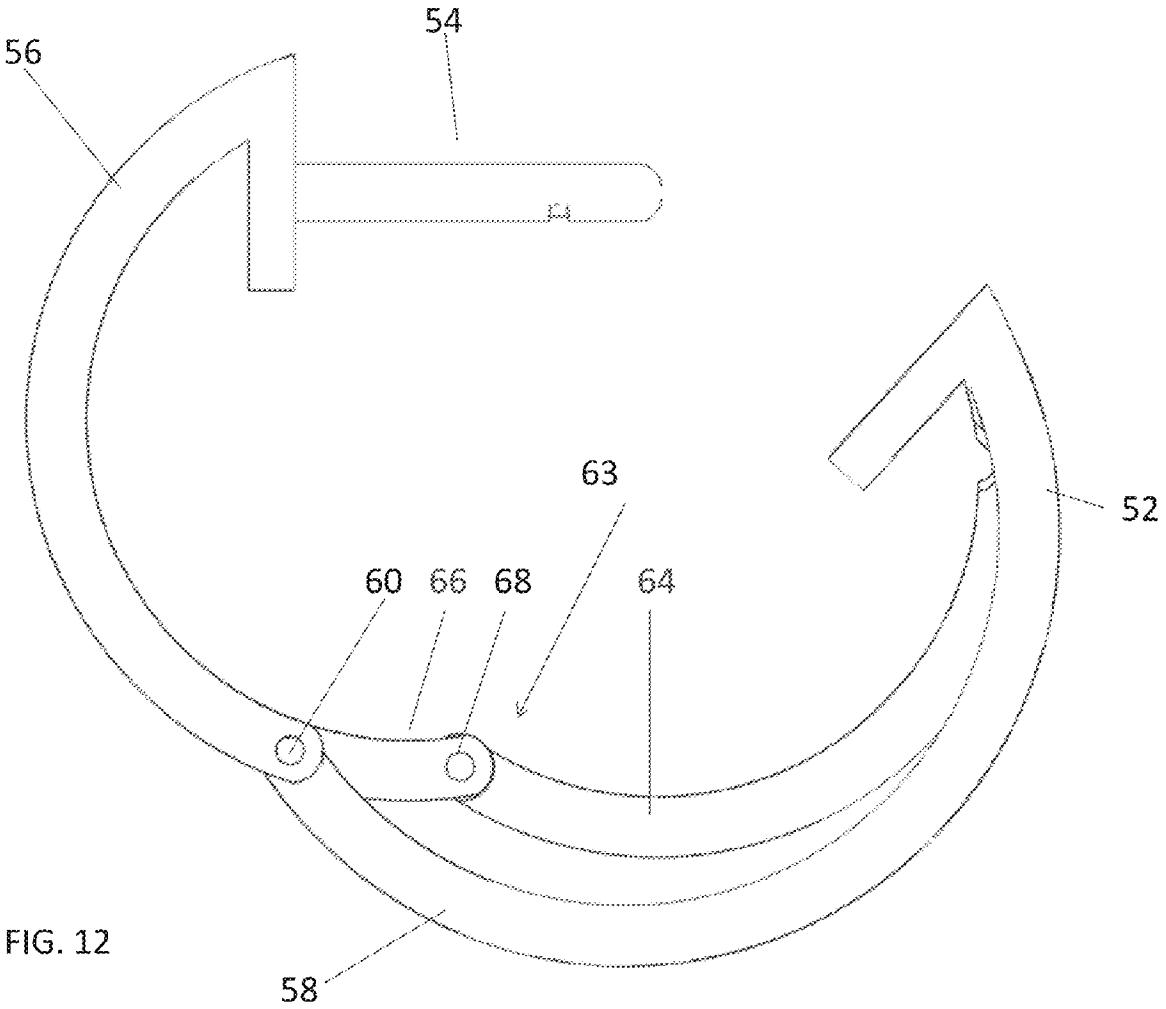
FIG. 12 is a side view of the caning of FIG. 11.

FIG. 12 is a side view of the caning of FIG. 11, also showing the open position. The same reference numerals used in FIG. 11 are used again.

Figure 13:
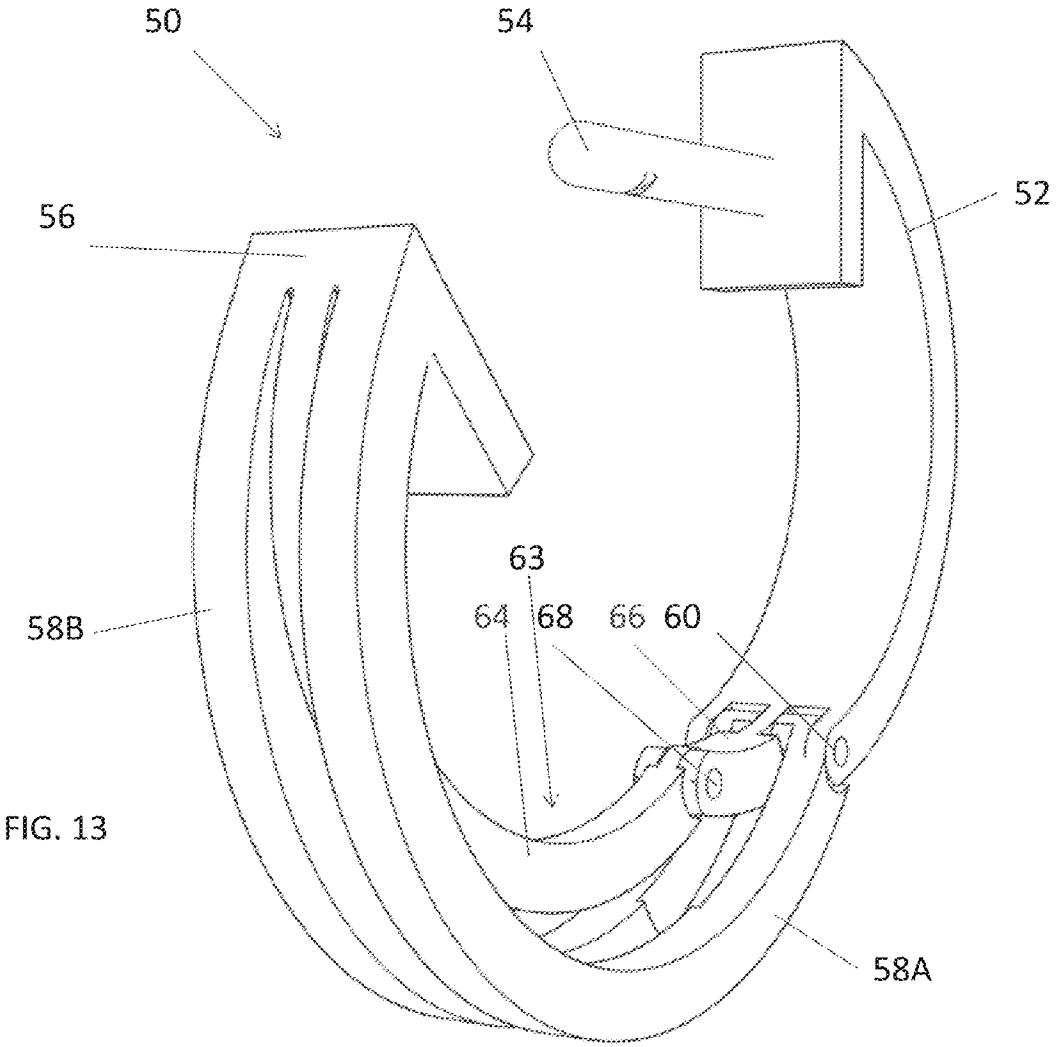
FIG. 13 is a perspective view of the earring of FIG. 11.

FIG. 13 is a perspective view of the earring of FIG. 11, and again the same reference numerals are used. Here it is seen that the closure is a triple arm wherein the ring spring part 56 consists of two outer arm parts 58A and 58B and the inner part 66 and lever 64 are a third inner arm part between the two outer arm parts.

Figure 14:
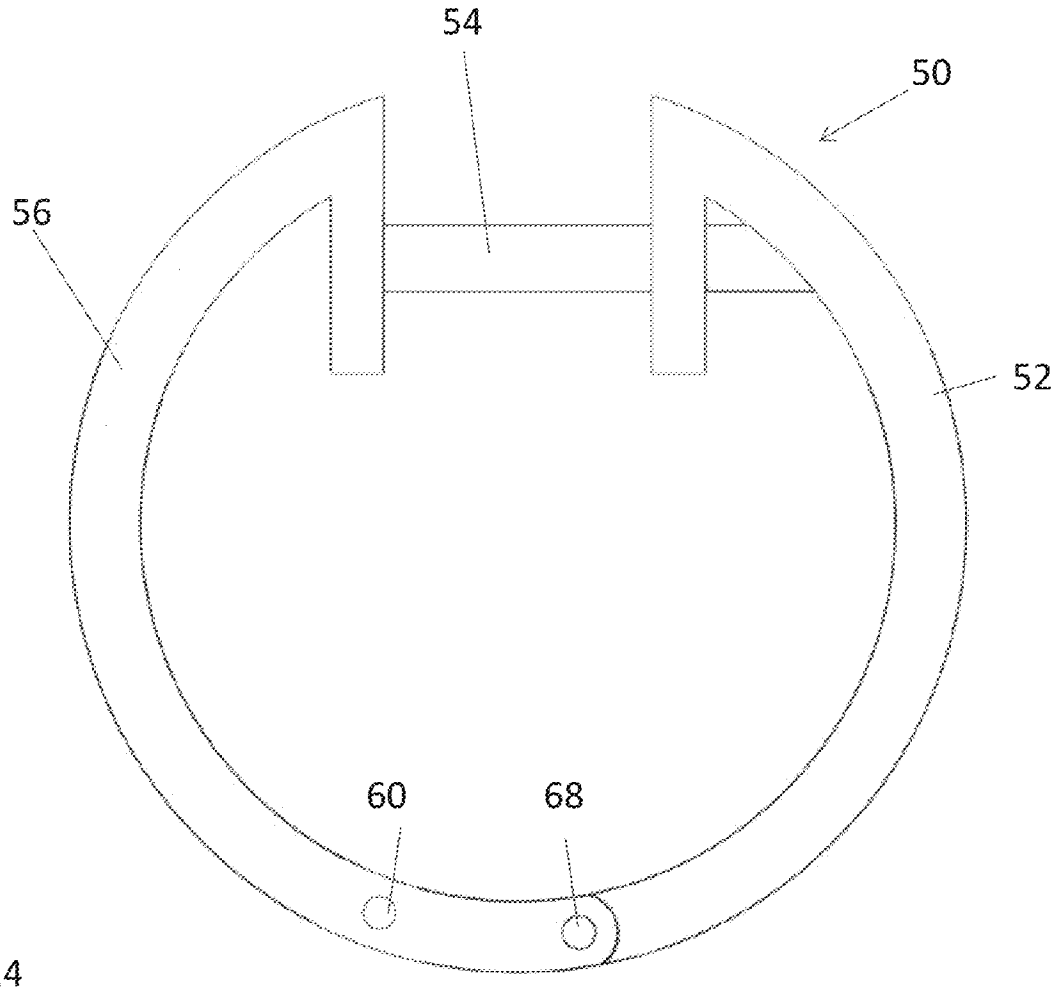
FIG. 14 is a side view of the caning of FIG. 11 in a closed position.

FIG. 14 is a simplified drawing showing the earring of FIG. 11 in a closed position. The inner part 64 and lever 66 are pressed into the circumference of the ring to create the stable closed position.

Figure 15:
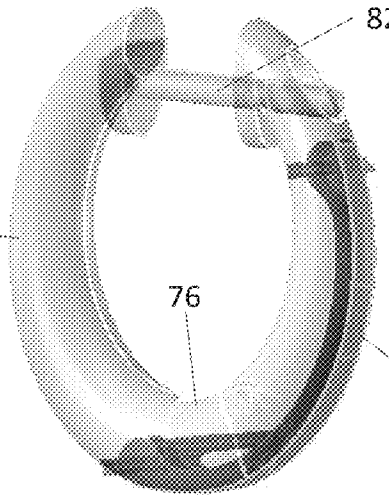
FIG. 15 is a side perspective view of a huggie caning according to a second embodiment of the present invention in a closed position.
Figure 17:
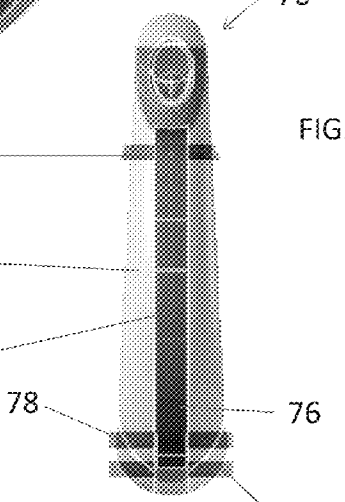
FIG. 17 is a view of the closure mechanism of the earring of FIG. 15.
Figure 16:
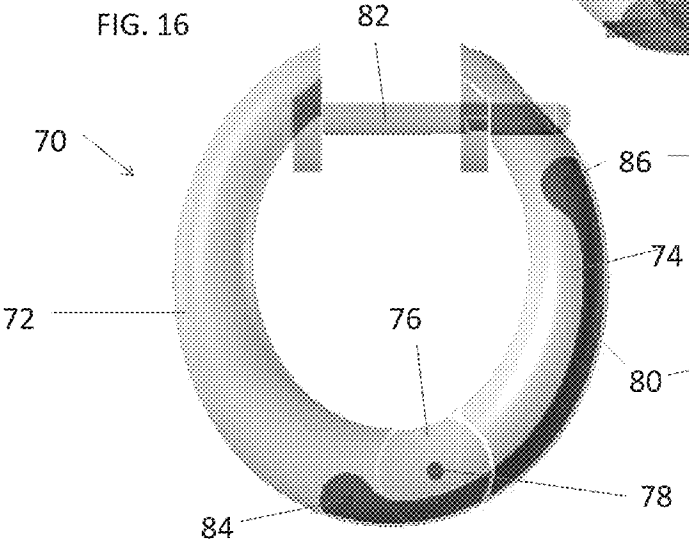
FIG. 16 is a side view of the caning of FIG. 15.
Figure 19:
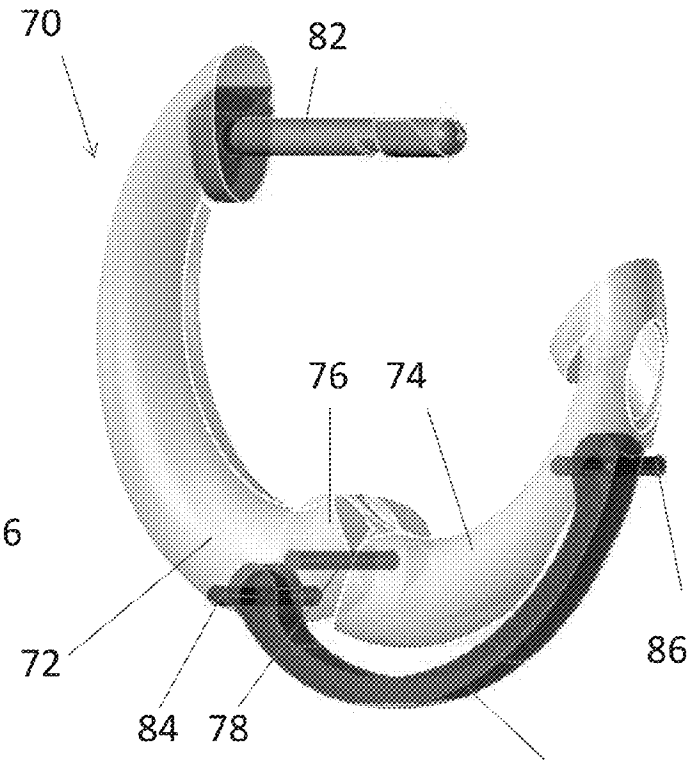
FIG. 19 is a side perspective view of the huggie earring of FIG. 15.
Figure 18:
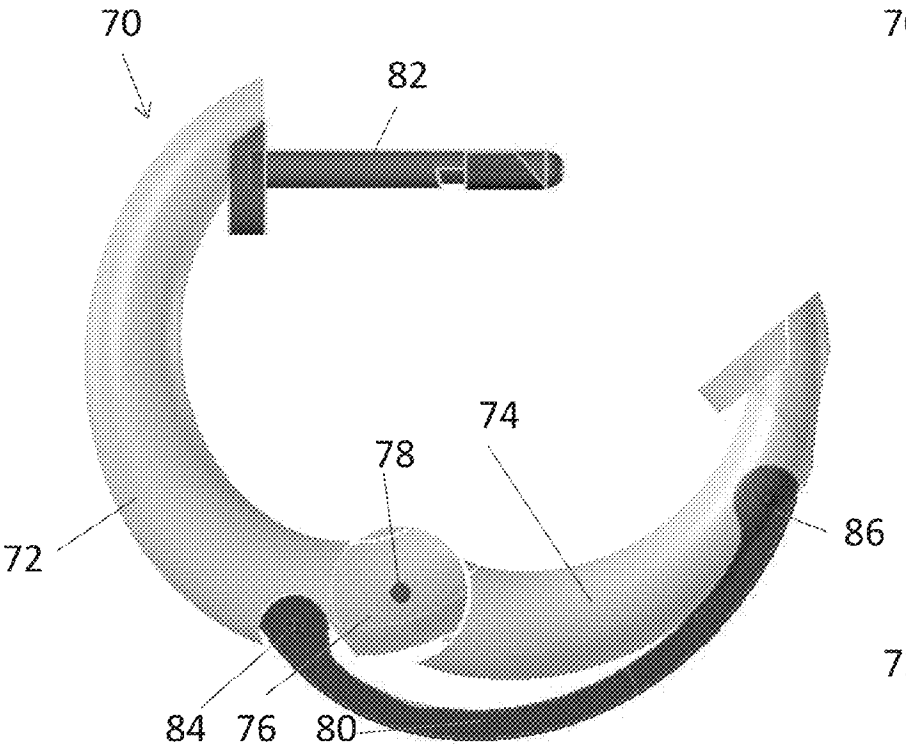
FIG. 18 is a side view of the huggie earring of FIG. 15 in an open position.

Reference is now made to FIGS. 15, 16, 17, 18 and 19, which illustrate a further embodiment of the present invention in which the spring part is located radially outwardly of the ring continuation part, and the ring continuation part is articulated. FIG. 15 is a perspective view of the earring when closed. FIG. 16 is a side view and FIG. 17 is a view looking directly downwards onto the closure. FIG. 18 is a side view of the earring in the open position and FIG. 19 is a side perspective view of the same.

A jewelry item 70, in this case a huggie earring, again has a ring part 72 and a closure 74. The closure 74 is continuous with the ring part 72 to form a ring circumference, and connects to the ring part via a hinge part 76. The hinge part 76 has a pivot 78 and provides articulation between the closure 74 and ring part 72. A spring 80 is pivoted between the closure 74 and the ring part across the hinge part, via pivots 84 and 86. In the closed position as in FIGS. 15 and 16 the spring is continuous with the ring circumference. In the open position as in FIGS. 18 and 19 the closure is opened and the spring snaps into a stable shape pulling the closure outward of the ring circumference. The result is to provide the closure with a first open stable position to open ear attachment pin 82, and a second closed stable position in which the earring is locked on the ear, and a snapping motion between the first and second stable positions.

Figure 21:
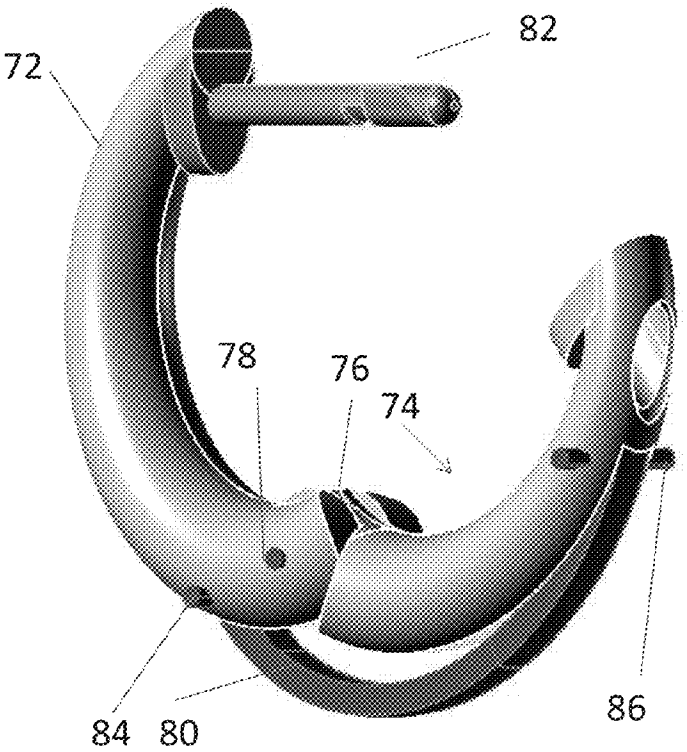
FIG. 21 is a side perspective view of the huggie caning of FIG. 20.
Figure 20:
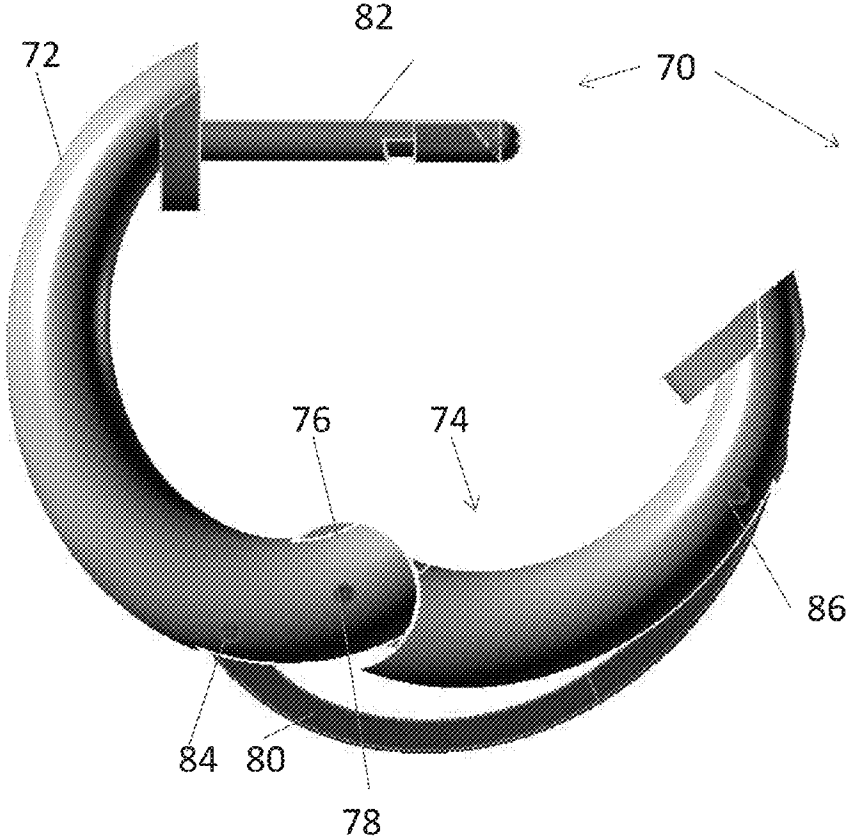
FIG. 20 is a side view of a huggie earring according to a third embodiment of the present invention in an open position.

FIGS. 20 and 21 show a variation of the embodiment of FIG. 15 in which there is no separate hinge part. Pivot 78 is mounted on a continuation of the ring part past the point at which the spring 80 is pivoted. FIG. 20 shows a side view of the open position and FIG. 21 shows a side perspective view of the open position.

Figure 22:
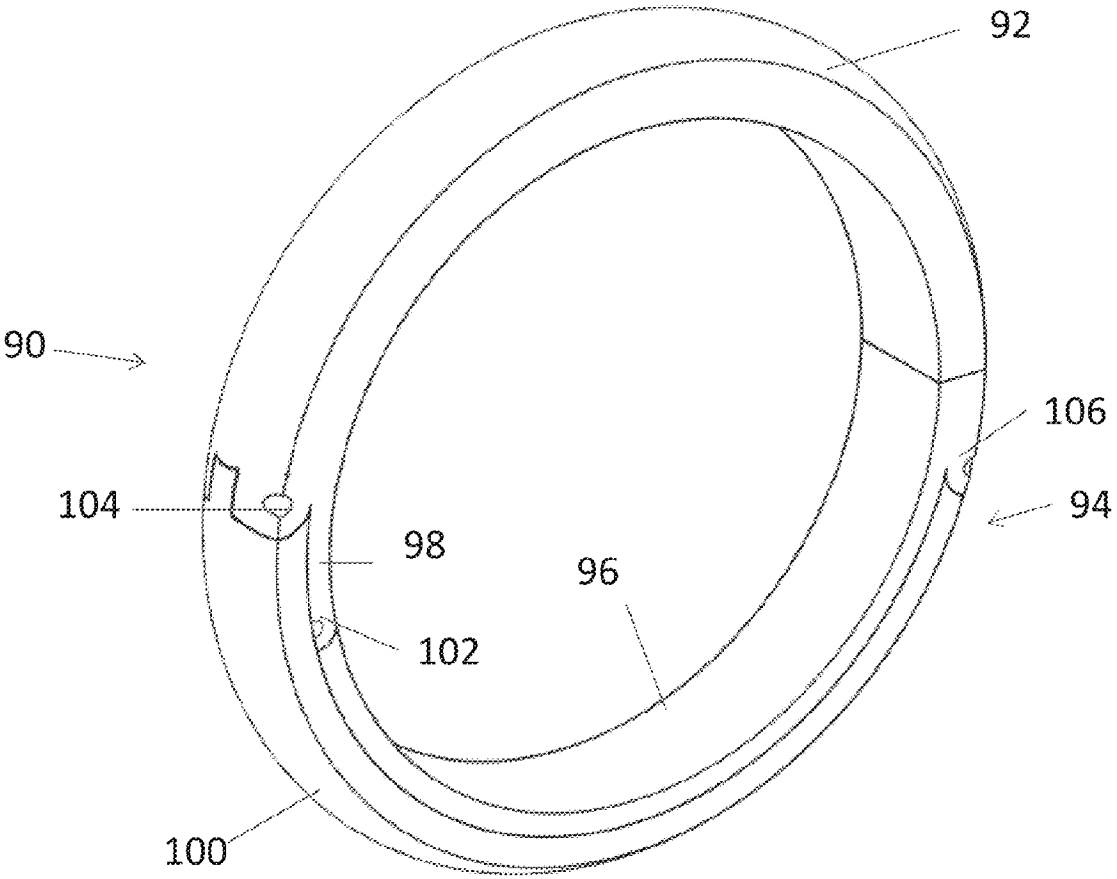
FIG. 22 is a perspective view of a ring in a closed position according to an embodiment of the present invention.
Figure 23:
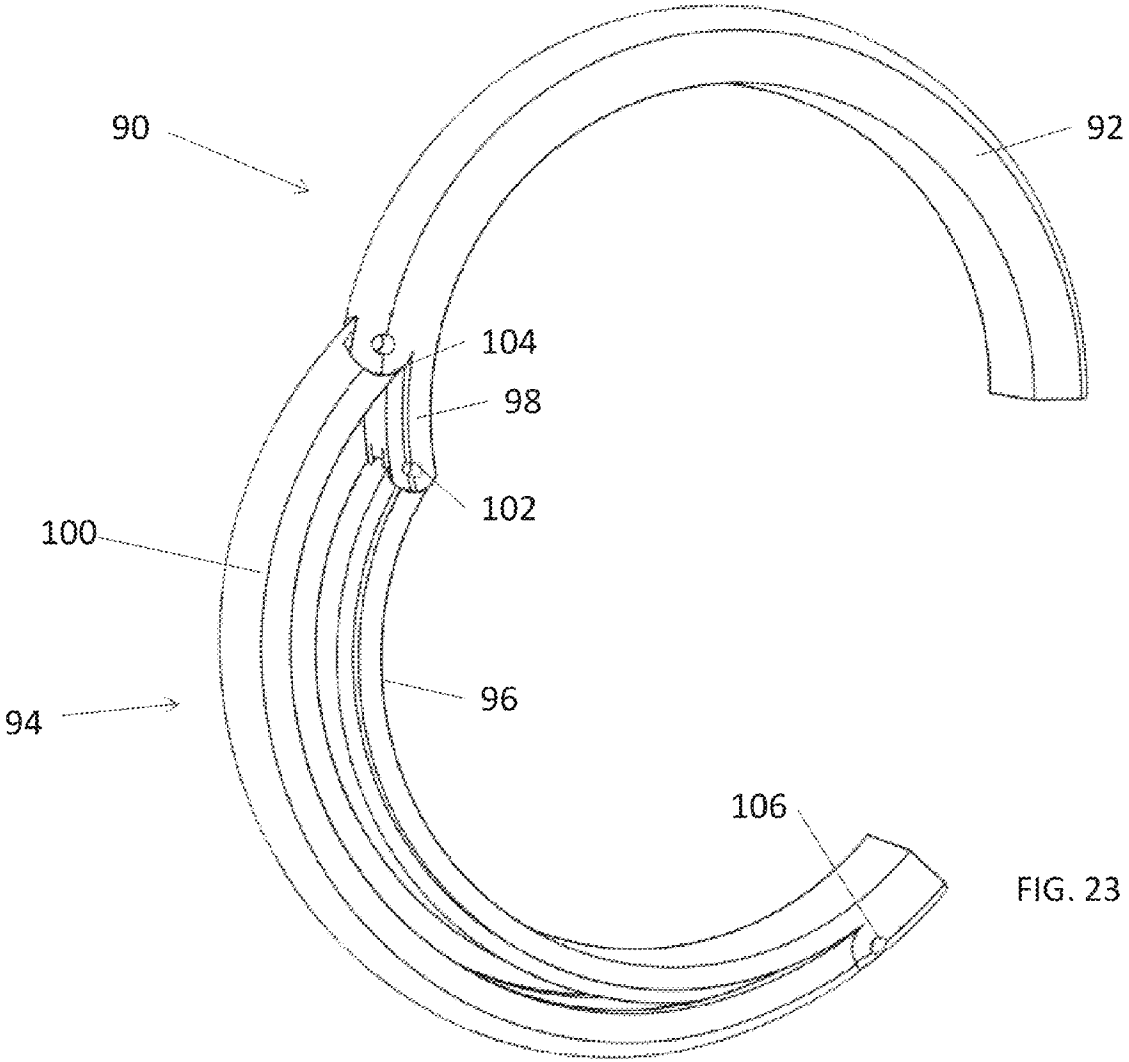
FIG. 23 is a perspective view of the ring of FIG. 22 in an open position.

Reference is now made to FIGS. 22 and 23, which show closed and open versions respectively of a ring according to the present embodiments. Although a ring is shown it will be appreciated that the same applies to a bracelet or bangle or the like. Ring 90 comprising a circumferential band 92 with a closure 94 being continuous with the band. The closure consists of a ring continuation main part 96 which is pivoted onto an extension 98 of the band 92 at pivot 102, and a spring arm 100 which is attached to the band 92 at point 104 which precedes extension 98. The far end of spring arm 100 is pivotally attached to the far end of the closure at pivot 106. The closure is stable in the two positions shown in FIGS. 22 and 23 respectively and snaps between them.

Figure 24A:
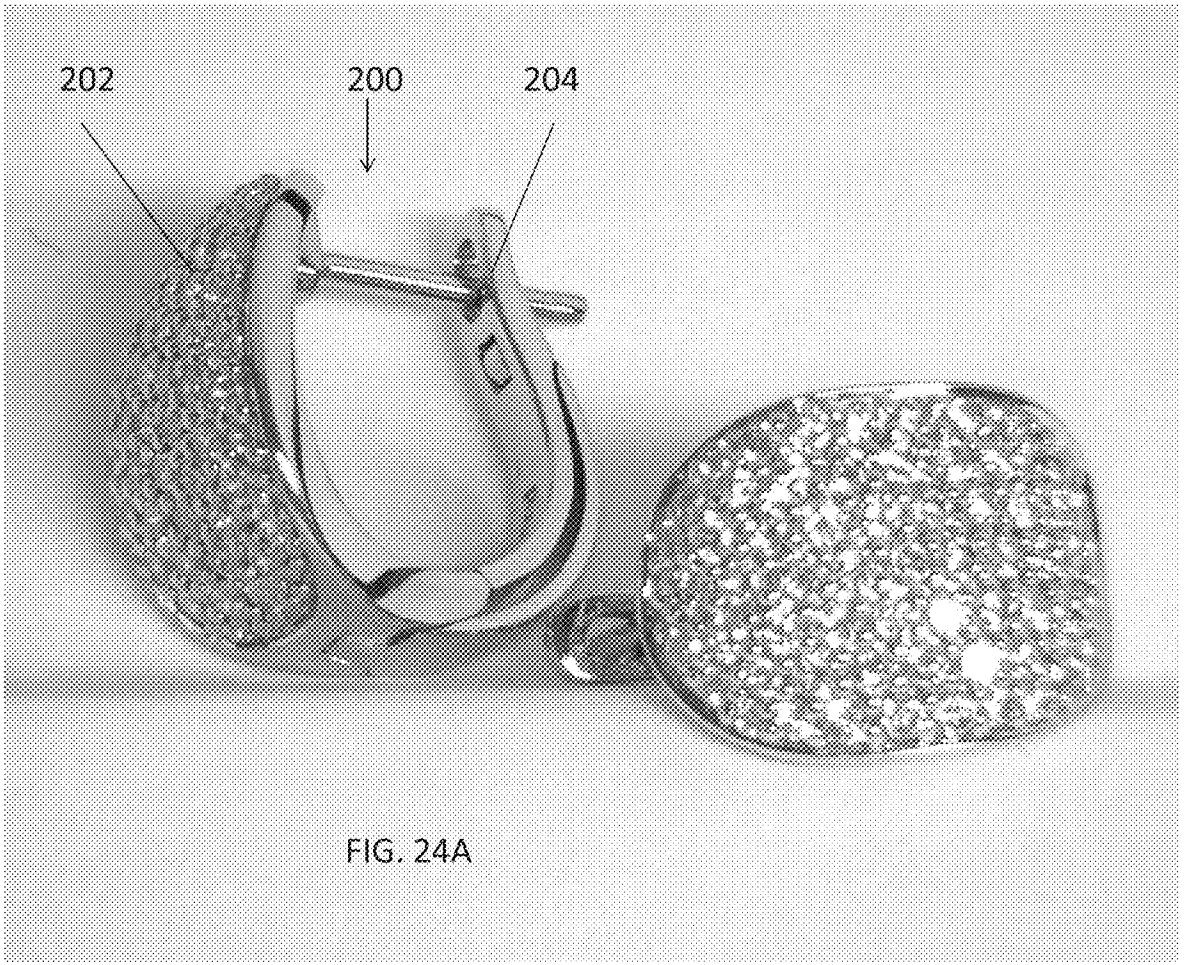
FIGS. 24A and 24B are different views of a huggie caning constructed according to the present embodiments.
Figure 24B:
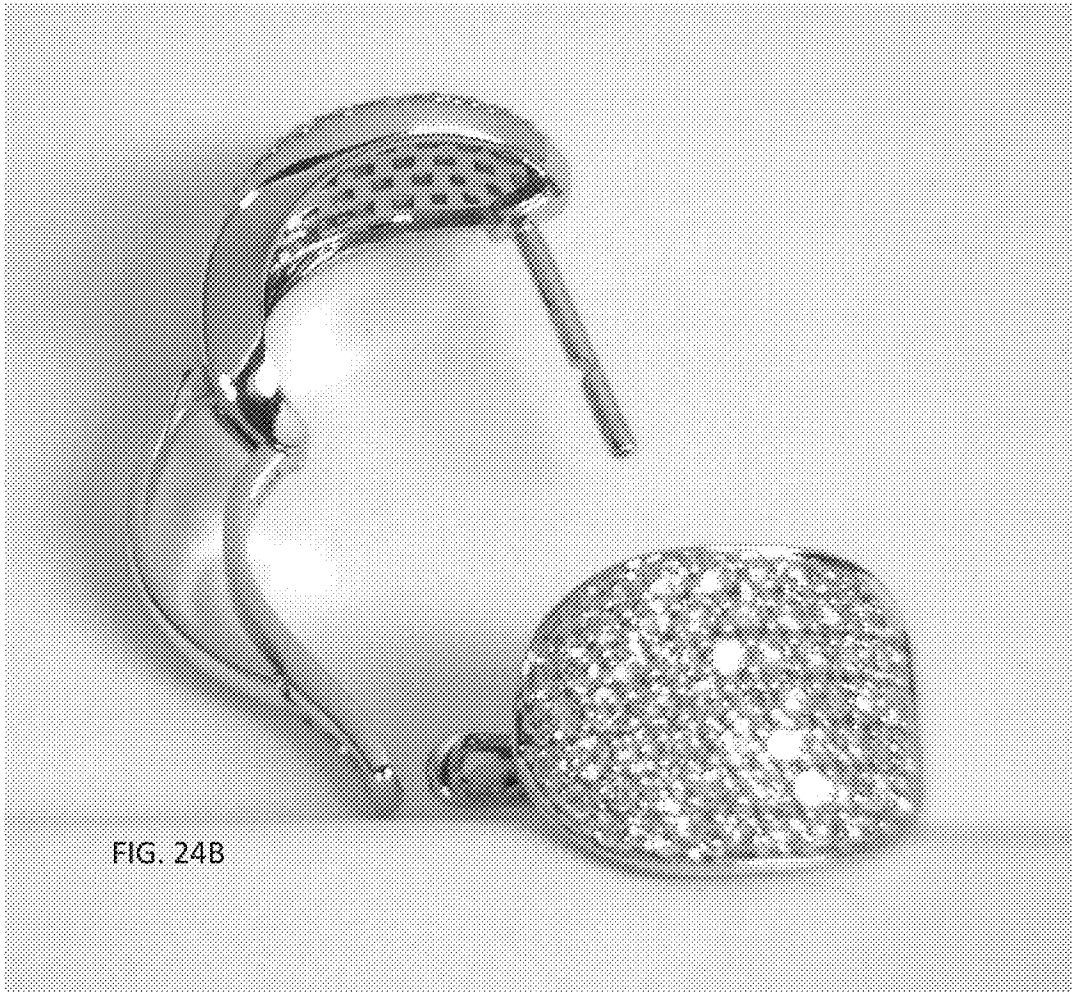

Reference is now made to FIGS. 24A and 24B, which are different views of a huggie earring constructed according to the present embodiments. The huggie earrings 200 comprise a mounting 202 and a finding 204, wherein the finding includes a closure according to the present embodiments as described hereinabove.

Figure 25A:
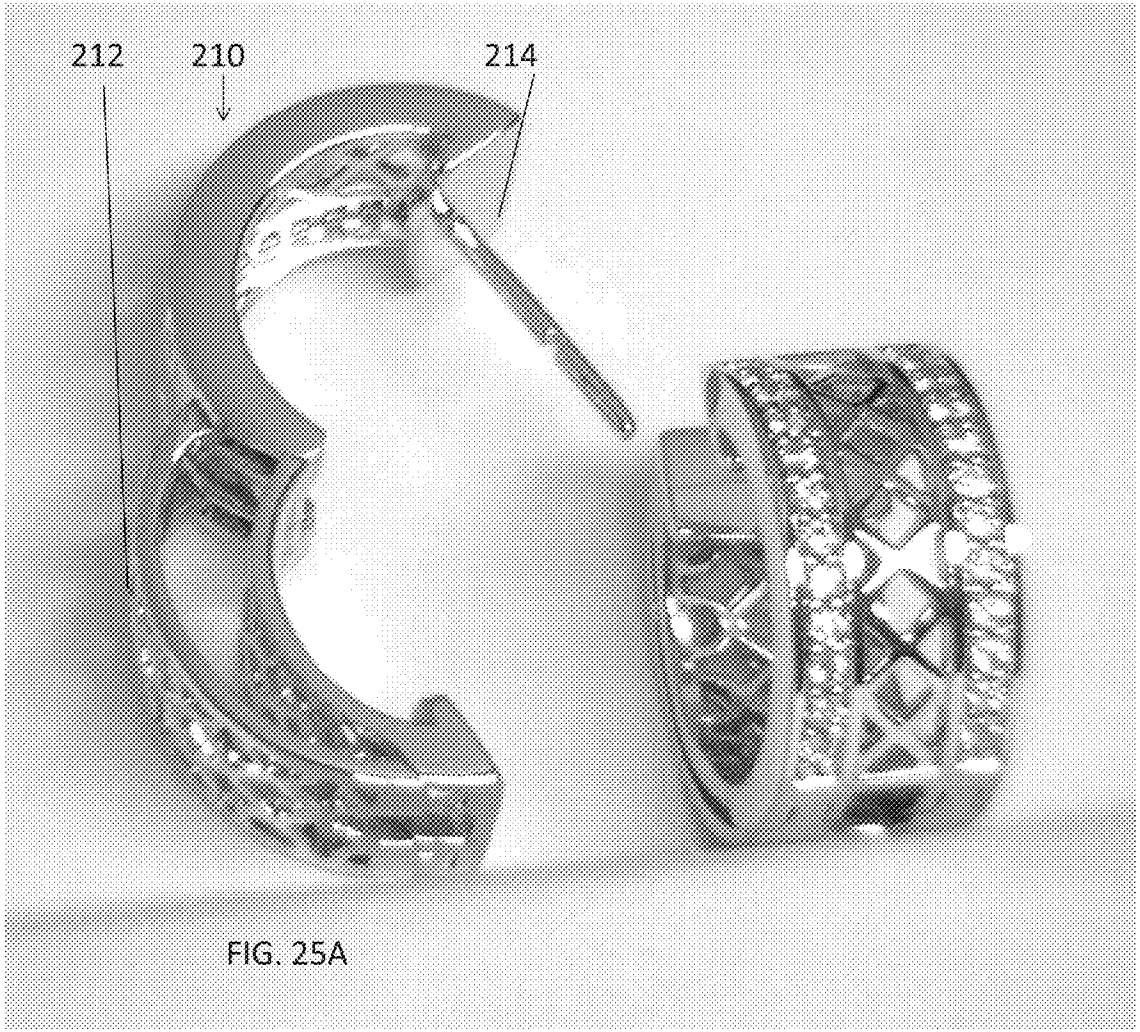
FIGS. 25A and 25B are different views of another huggie earring constructed according to the present embodiments.
Figure 25B:
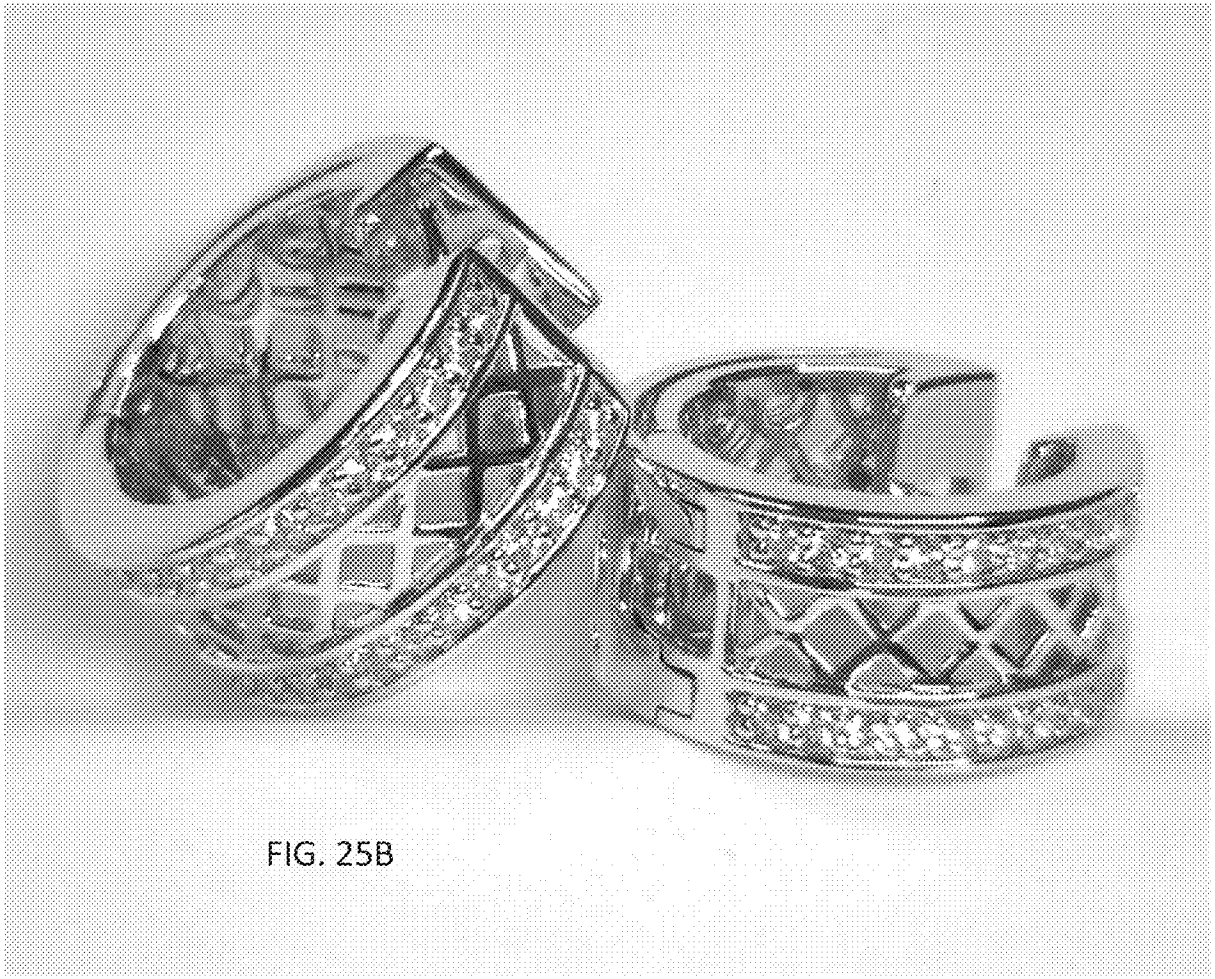

FIGS. 25A and 25B are different views of another huggie earring constructed according to the present embodiments. The huggie earrings 210 comprise a setting 212 and a finding 214, wherein the finding includes a closure according to the present embodiments as described hereinabove.

Figure 26A:
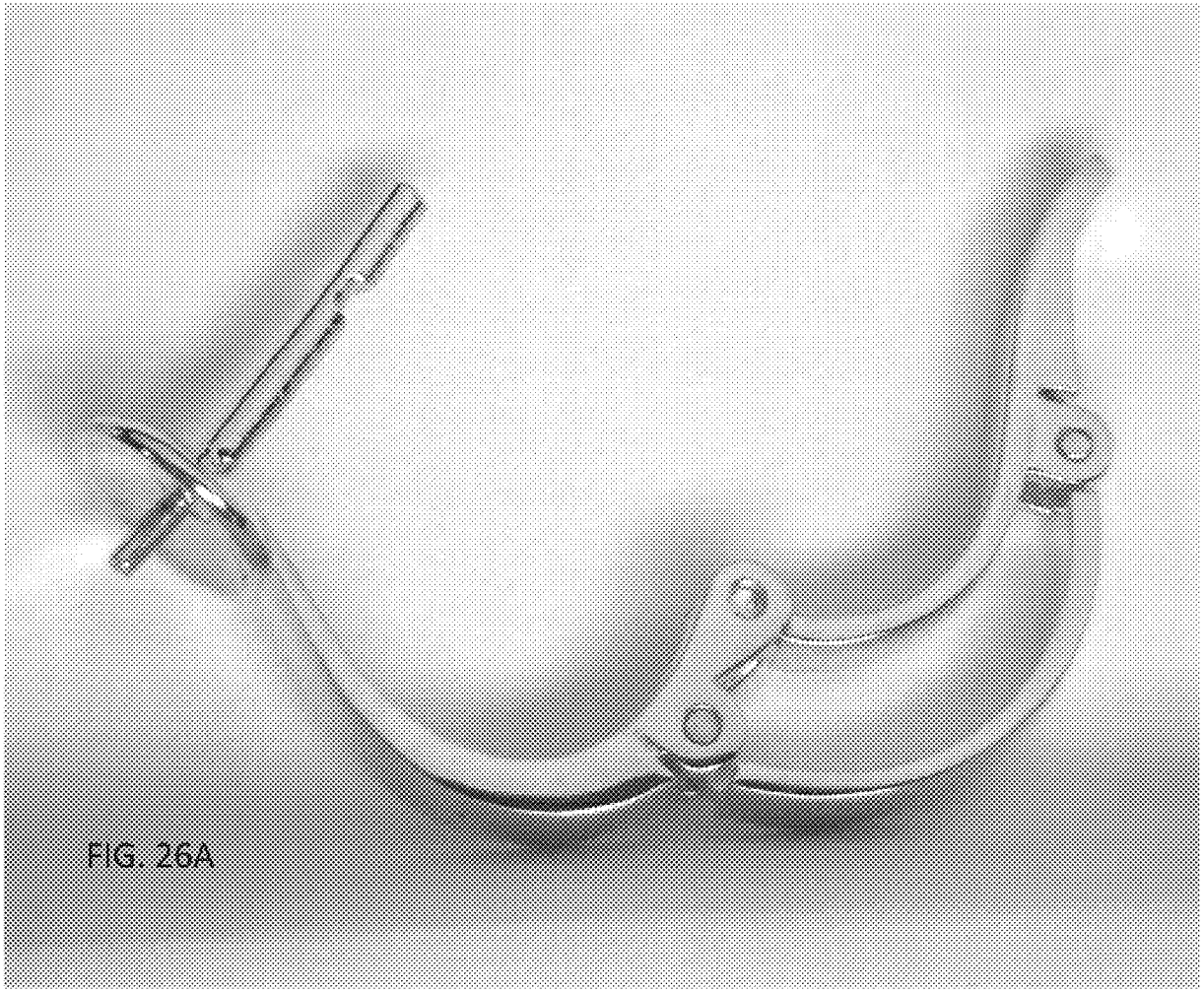
FIGS. 26A, 26B and 26C are different views of yet another huggie earring constructed according to the present embodiments.
Figure 26B:
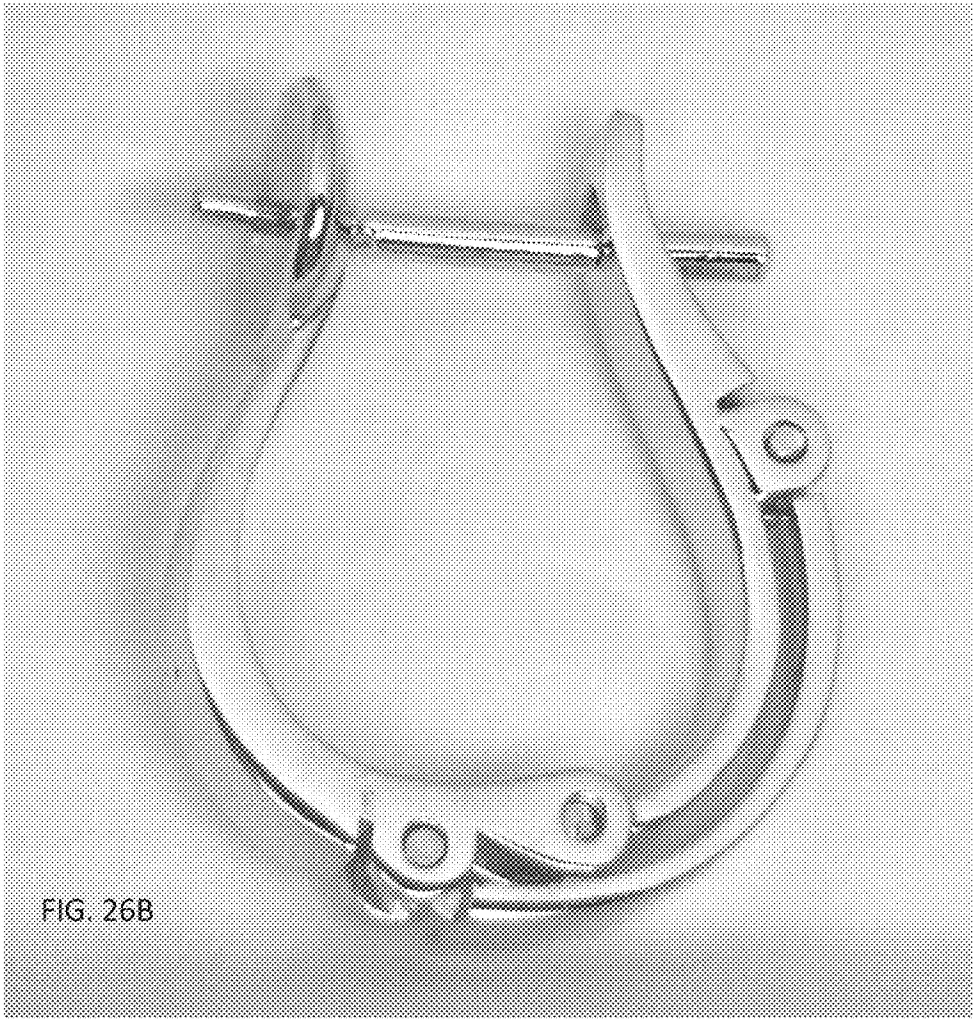

FIGS. 26A, 26B and 24C are different views of yet another huggie earring constructed according to the present embodiments. In the example of FIG. 26A the finding is itself decorative and there is no separate setting. FIG. 26A illustrates the earring in the open position, and FIGS. 26B and 26C illustrate the caning at two different angles in the closed position.

Figure 27A:
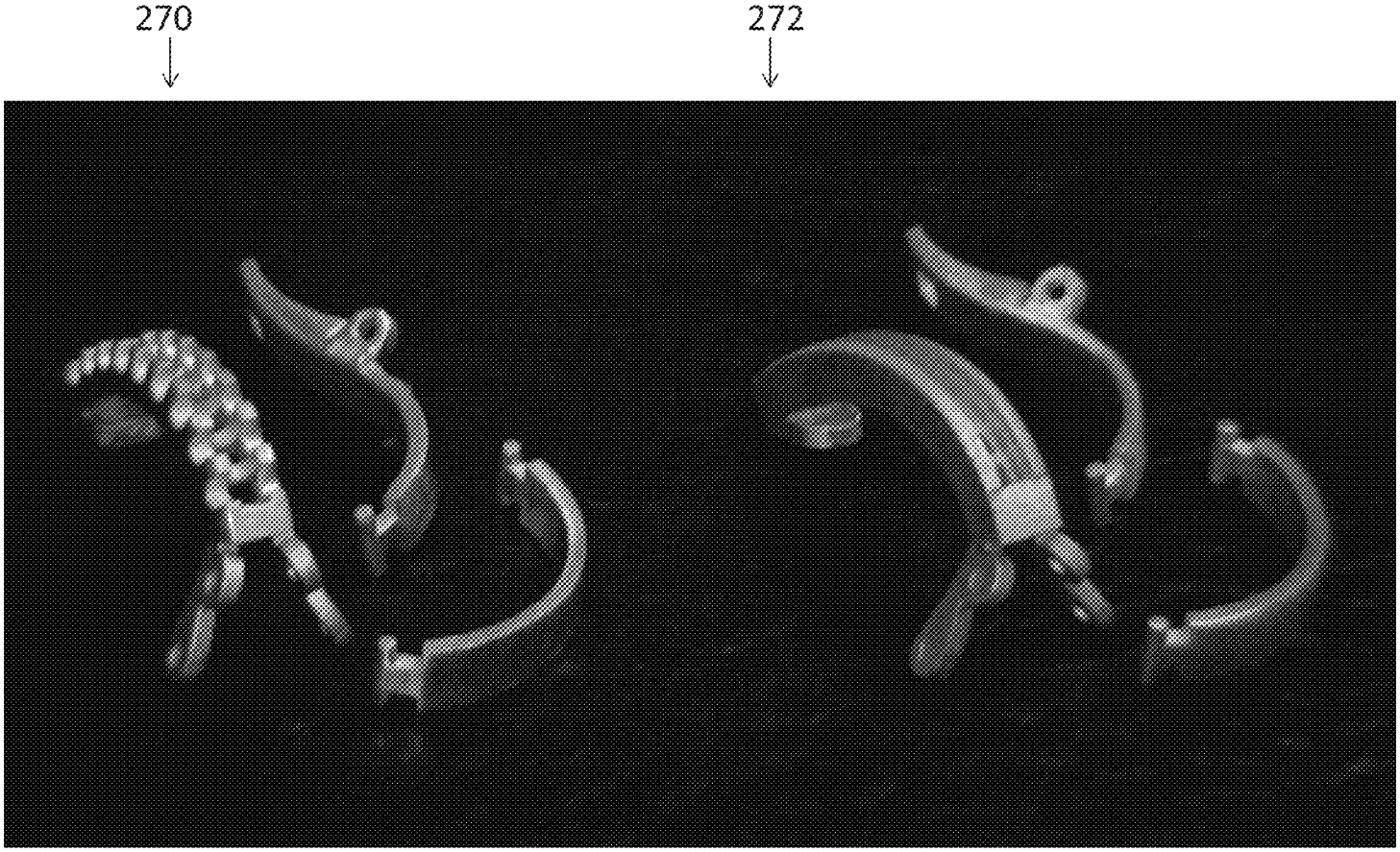
FIG. 27A illustrates two kits of parts to construct two different findings for a huggie caning according to the present embodiments.

Reference is now made to FIG. 27A, which illustrates two different kits of parts, 270 and 272, to construct two different findings for various huggie earrings according to the present embodiments. The finding may be provided in kit form to the high-end jeweler, who will then assemble the finding and mount his own setting.

Figure 27B:
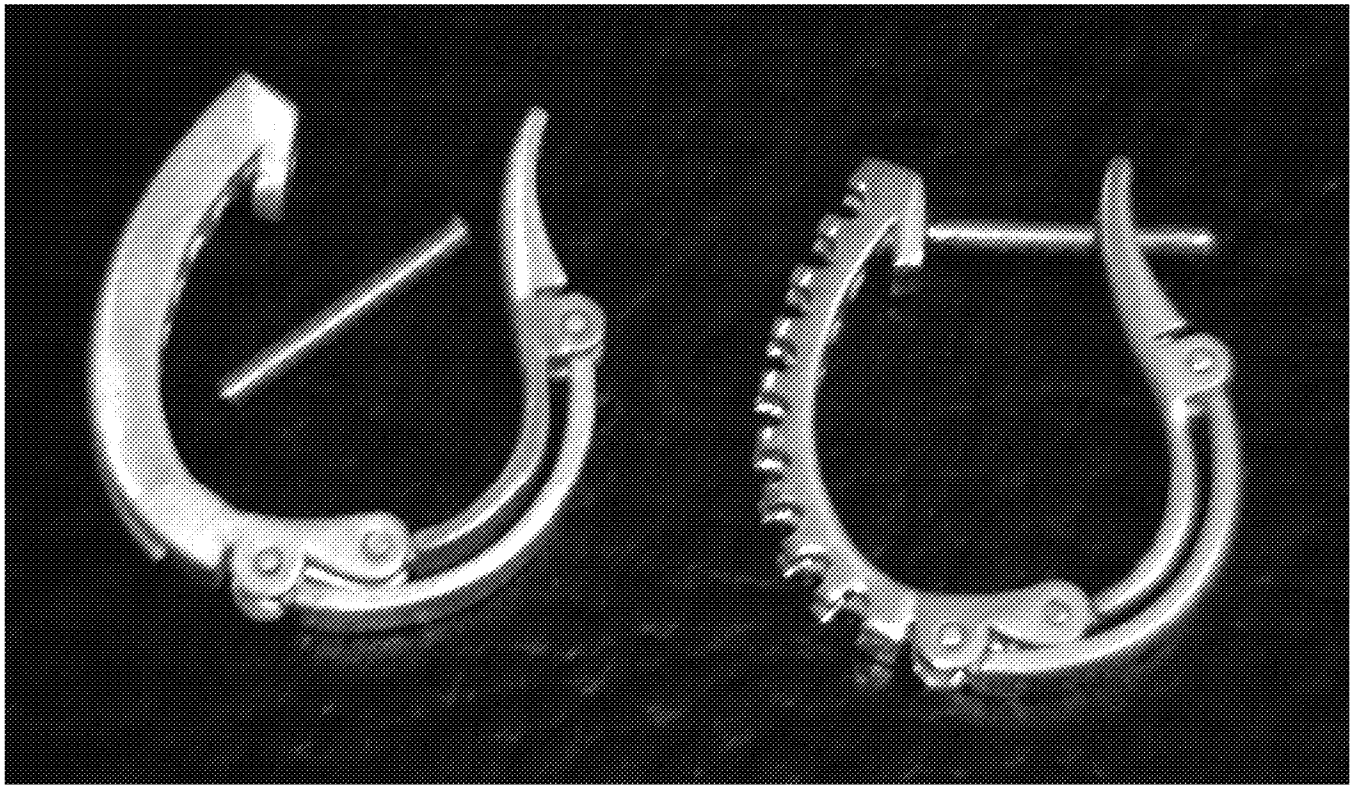
FIG. 27B illustrates the two kits of parts of FIG. 27A after partial and full construction respectively.

FIG. 27B shows the first finding 270, in which the closure is constructed but the pin is not, so that the finding is incomplete. The second finding 272 is fully constructed. In both cases the findings are shown prior to the placement of the setting.

Figure 26C:
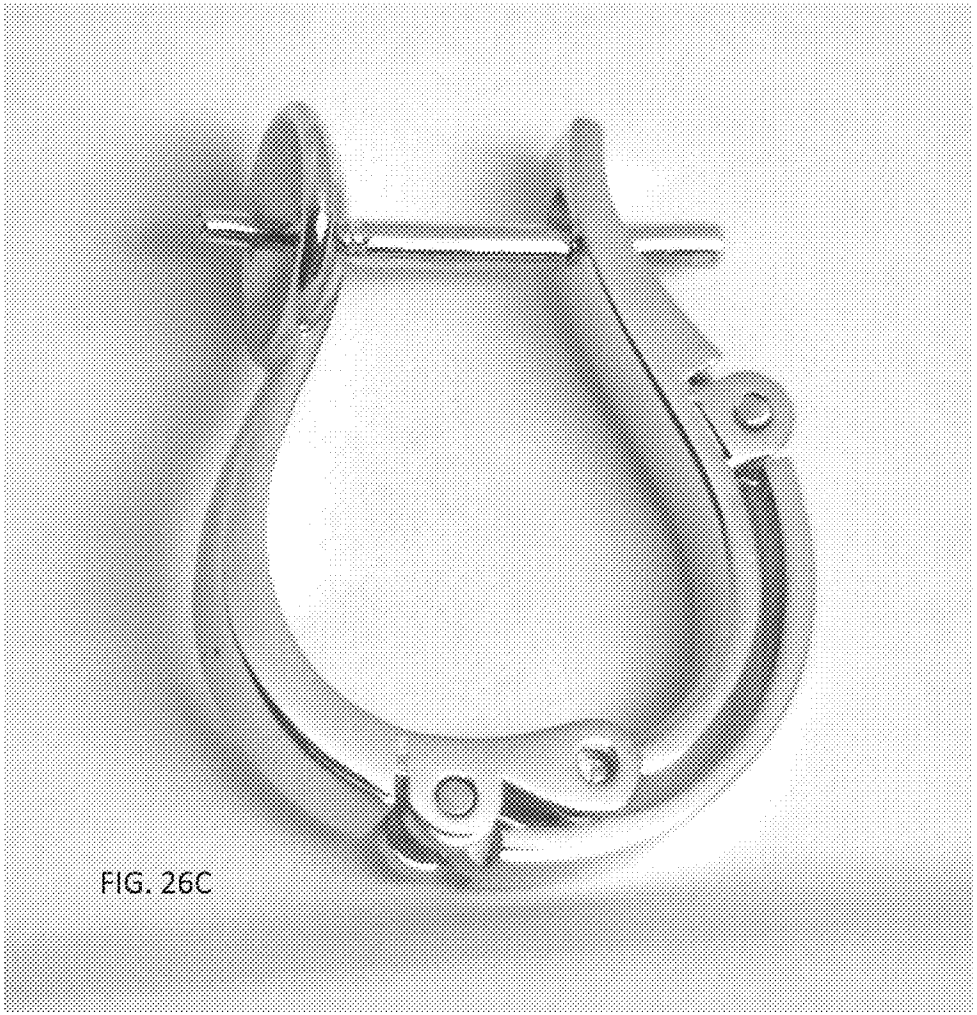
Figure 28A:
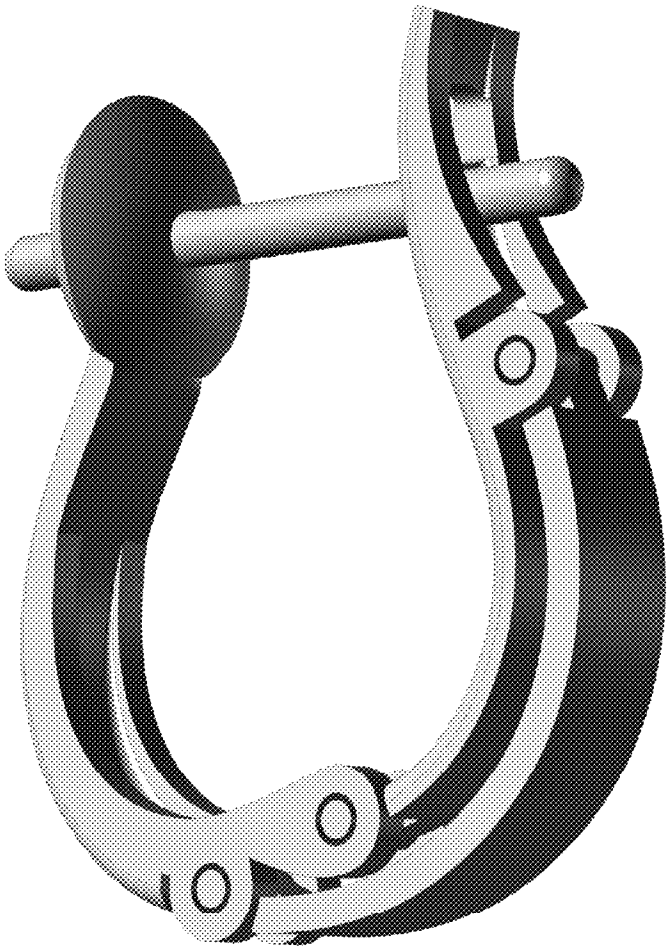
FIGS. 28A, 28B and 28C illustrate the huggie earring of FIGS. 26A-C constructed and as a kit of parts.
Figure 28B:
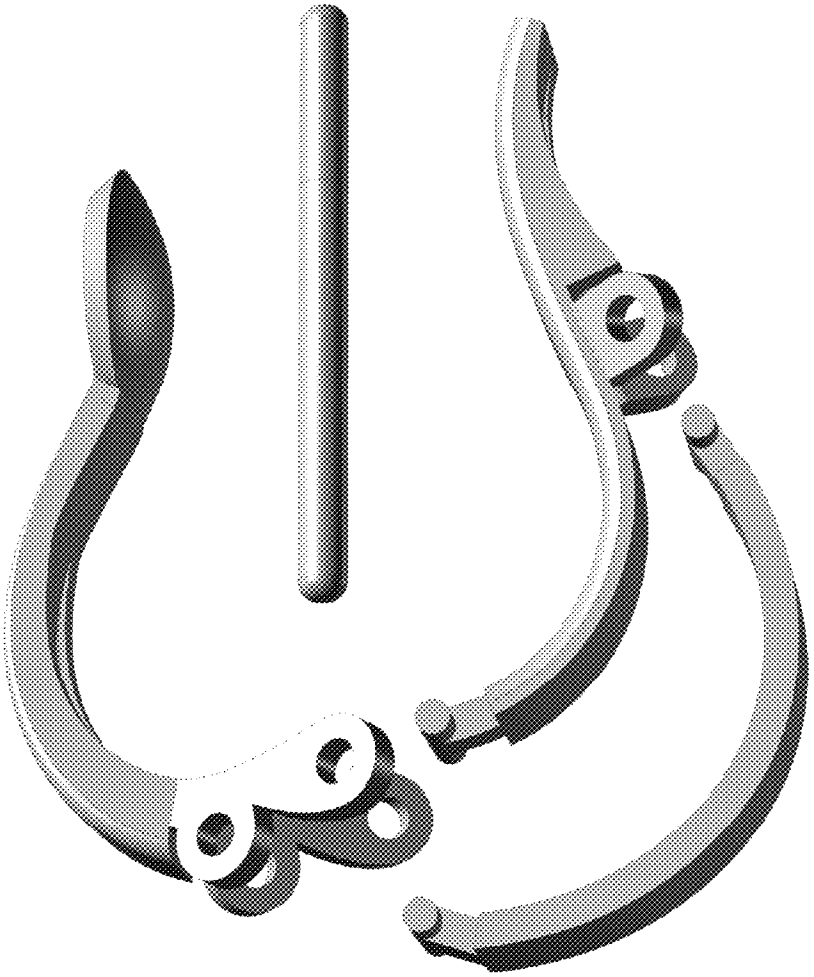
Figure 28C:
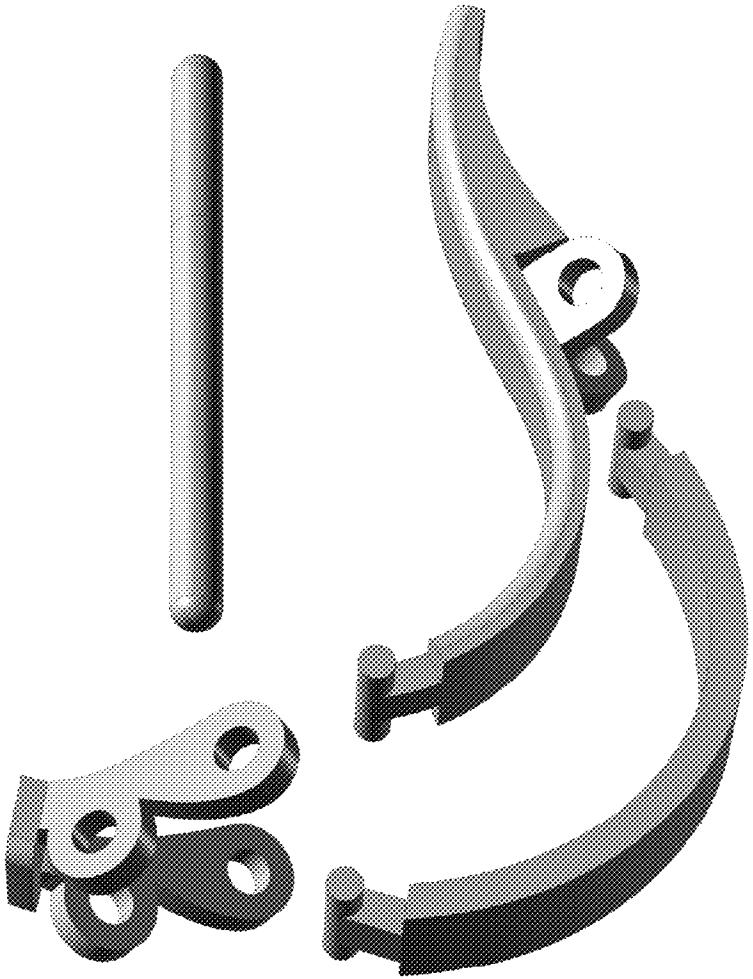

FIGS. 28A, 28B and 28C illustrate the huggie earring of FIGS. 26A-26C constructed as in FIG. 28A and as a kit of parts in FIGS. 28B and 28C.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that all features of the invention, which are, for clarity, described in the context of separate embodiments, may also be provided in combination in a single embodiment, and this document is to be understood as if such features are explicitly included. Conversely, various features of the invention, which are, for brevity, described in the context of a single embodiment, may also be provided separately or in any suitable subcombination or as suitable in any other described embodiment of the invention, and this document is to be understood as though such inclusions are explicitly made. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A jewelry item, the jewelry item having a ring part pivotally attached to a closure at a pivotal connection at a first end of said ring part, the closure comprising a ring continuation arm from said first end of the ring part, the closure further comprising a bias arm extending along with the ring continuation arm along said ring continuation arm, the bias arm comprising a spring part and a lever part pivotally attached to each other, a connection between said lever part and the ring part being rigid, so that as the ring part is opened, said lever part is configured to rotate inwardly towards an interior of said item, pulling the pivoted end of said spring part to establish a stable open position, the lever part being configured to push the spring part outwardly towards the ring continuation arm when the ring part is closed, to establish a second stable position to close the closure, the spring part of the bias arm comprising a leaf spring, the leaf spring being connected to the ring continuation arm.

2. The jewelry item of claim 1, wherein said lever part is relatively shorter than said spring part.

3. The jewelry item of claim 2, wherein said spring part is approximately four times as long as said lever part.

4. The jewelry item of claim 2, being a huggie style earring.

5. The jewelry item of claim 1, wherein the jewelry item is an earring, the earring comprising a pin for insertion into an ear, and the closure being for closing the pin against said ring part, a first end of said closure being on the ring part and the second end being a free end, the second stable position being a closed position in which the closure receives an end of the pin to close the earring and the stable open position being a position in which the closure is spaced away from the pin to open the earring.

6. The jewelry item of claim 1, wherein the jewelry item is a ring or a bracelet, the ring comprising a band and the closure forming a part of the band, the second stable position being a closed position in which the closure closes the band to a uniform ring circumference and the stable open position being a position in which the band is opened beyond said circumference.

7. The jewelry item of claim 1, wherein said spring part extends inwardly of a circumference of said ring continuity when said closure is opened.

8. The jewelry item of claim 7, wherein said spring part remains within said circumference when said closure is opened.

9. The jewelry item of claim 1, being a finding for an earring.

10. A kit of parts for constructing the jewelry item of claim 1.

11. A jewelry item comprising a ring part and a closure, the closure being continuous with the ring part and connecting to said ring part at a first end, the closure comprising a continuation of said ring part and a spring arm pivoted to said continuation at a first location thereon and further pivoted to said ring part at a second location, said continuation having a pivoted hinge located at said first end, said first end being between said first location and said second location, the spring arm being a leaf spring, thereby providing said closure with a first open stable position and a second closed stable position and a snapping motion between said first and second stable positions, wherein said first end is closer to said first location than to said second location.

12. The jewelry item of claim 11, wherein said connecting between said ring part and said continuation is via a pivot.

13. The jewelry item of claim 11, wherein said connecting between said ring part and said continuation is continuous.

14. The jewelry item of claim 11, being a huggie style earring.

15. The jewelry item of claim 11, wherein the jewelry item comprises an earring, the earring comprising a setting and a pin, and the closure for closing over the pin, the pin having a first end and a second end, the first end being on the setting and the second end being a free end of the pin, the first position being a position in which the closure connects to the pin to close the earring and the second position being a position in which the closure is spaced away from the pin to open the earring, or wherein the jewelry item comprises a ring or a bracelet, the ring comprising a band and the closure being incorporated into the band, the first and second ends being on the band, the first position being a position in which the closure connects the band to close the ring and the second position being a position in which the closure opens the band, wherein said leaf spring sits within an outer circumference of said item when said closure is closed, and said leaf spring extends outwardly when said closure is opened.

* * * * *